US008939161B2

(12) United States Patent
Schmitt

(10) Patent No.: US 8,939,161 B2
(45) Date of Patent: Jan. 27, 2015

(54) CLEANING SYSTEM FOR AN ELECTRIC SHAVER

(75) Inventor: Paul Schmitt, Madison, WI (US)

(73) Assignee: Spectrum Brands, Inc., Middleton, WI (US)

( * ) Notice: Subject to any disclaimer, the term of this patent is extended or adjusted under 35 U.S.C. 154(b) by 1189 days.

(21) Appl. No.: 12/409,808

(22) Filed: Mar. 24, 2009

(65) Prior Publication Data

US 2010/0243008 A1 Sep. 30, 2010

(51) Int. Cl.
*B08B 3/00* (2006.01)
*A45D 27/46* (2006.01)

(52) U.S. Cl.
CPC ..... *A45D 27/46* (2013.01)
USPC ..... 134/136; 30/538

(58) Field of Classification Search
CPC ..... A45D 27/46
USPC ..... 30/538
See application file for complete search history.

(56) References Cited

U.S. PATENT DOCUMENTS

| | | | |
|---|---|---|---|
| 1,789,648 | A | 1/1931 | Fowler |
| 1,886,578 | A | 11/1932 | Pedrazzo |
| 2,002,795 | A | 5/1935 | Przyborowski |
| 2,313,970 | A | 3/1943 | Roderick |
| 2,814,575 | A | 11/1957 | Lange, Jr. |
| 3,032,939 | A | 5/1962 | Andersen |
| 3,172,416 | A | 3/1965 | Simmons |
| 4,721,124 | A | 1/1988 | Tuerkheimer et al. |
| 5,147,575 | A | 9/1992 | Hampton, Sr. |
| 5,614,030 | A | 3/1997 | Braun |
| 5,649,556 | A | 7/1997 | Braun |
| 5,711,328 | A | 1/1998 | Braun |
| 6,263,890 | B1 | 7/2001 | Höser |
| D449,708 | S | 10/2001 | Ullmann |
| 6,305,391 | B1 | 10/2001 | Höser |
| 6,371,136 | B1 | 4/2002 | Höser |

(Continued)

FOREIGN PATENT DOCUMENTS

| | | |
|---|---|---|
| DE | 10244050 A1 | 4/2004 |
| JP | 2001096082 | 4/2001 |

(Continued)

OTHER PUBLICATIONS

European Search Report for 10250521.1, dated Aug. 4, 2010, 4 pages.

(Continued)

*Primary Examiner* — Jason Ko
(74) *Attorney, Agent, or Firm* — Armstrong Teasdale LLP

(57) ABSTRACT

A cleaning system for an electric shaver having a shaving head generally includes a housing having an interior space configured to retain cleaning fluid within the housing. The housing is further configured for supporting the shaver in a generally upright orientation with the shaving head disposed at least in part within the interior space of the housing. A displacement apparatus is disposed within the interior space of the housing and is selectively positionable within the housing between a first position in which the cleaning fluid within the housing defines a lower fluid level relative to the shaving head to be cleaned, and a second position in which the cleaning fluid defines a higher fluid level relative to the shaving head such that at the higher fluid level at least a portion of the shaving head of the shaver is submerged in the cleaning fluid within the housing.

18 Claims, 21 Drawing Sheets

(56) References Cited

U.S. PATENT DOCUMENTS

| | | | |
|---|---|---|---|
| 6,626,194 | B2 | 9/2003 | Wong |
| 6,640,819 | B2 | 11/2003 | Höser et al. |
| 6,698,437 | B2 | 3/2004 | Höser et al. |
| 6,792,960 | B2 | 9/2004 | Peele et al. |
| 6,874,514 | B1 | 4/2005 | Höser et al. |
| 7,059,336 | B2 | 6/2006 | Höser et al. |
| 7,107,692 | B2 | 9/2006 | Kappes et al. |
| 7,143,517 | B2 | 12/2006 | Kappes et al. |
| 7,150,285 | B2 | 12/2006 | Saito et al. |
| 7,225,817 | B2 | 6/2007 | Eichhorn et al. |
| 7,261,110 | B2 | 8/2007 | Kappes et al. |
| 7,316,236 | B2 | 1/2008 | Höser |
| 7,361,232 | B2 | 4/2008 | Chasen et al. |
| 7,409,960 | B2 | 8/2008 | Höser et al. |
| 7,451,770 | B2 | 11/2008 | Saito et al. |
| 7,487,786 | B2 | 2/2009 | Höser et al. |
| 2003/0226581 | A1 | 12/2003 | Peele et al. |
| 2005/0189003 | A1 | 9/2005 | Saito et al. |
| 2005/0189004 | A1 | 9/2005 | Höser et al. |
| 2006/0011225 | A1 | 1/2006 | Saito et al. |
| 2006/0048802 | A1 | 3/2006 | Kappes et al. |
| 2006/0053642 | A1 | 3/2006 | Kappes |
| 2006/0162749 | A1 | 7/2006 | Saito et al. |
| 2008/0060689 | A1 | 3/2008 | Takizawa et al. |
| 2008/0210271 | A1 | 9/2008 | Chasen et al. |
| 2009/0019702 | A1 | 1/2009 | Wevers et al. |

FOREIGN PATENT DOCUMENTS

| | | | |
|---|---|---|---|
| JP | 2007330709 | | 12/2007 |
| JP | 2008212574 | A | 9/2008 |
| JP | 2008279143 | | 11/2008 |
| WO | 03073885 | A1 | 12/2003 |
| WO | 2004032669 | A1 | 4/2004 |
| WO | 2004086901 | A1 | 10/2004 |
| WO | 2004086902 | A1 | 10/2004 |
| WO | 2005016061 | A1 | 2/2005 |
| WO | 2006018745 | A1 | 2/2006 |
| WO | 2008075243 | A1 | 6/2008 |

OTHER PUBLICATIONS

European Search Report for 10250527.8, dated Aug. 4, 2010, 4 pages.

CLEANING SYSTEM FOR AN ELECTRIC SHAVER

BACKGROUND

The present invention relates generally to electric shavers and, more particularly, to a cleaning system for an electric shaver.

Electric shavers have been known to exhibit optimum cutting effectiveness when the shaver head components move freely. As such, cleaning the shaver head on a regular basis is often recommended to facilitate smooth operation of the shaver head components. However, routine cleaning can be time-consuming and is often avoided, resulting in a buildup of debris inside the shaver head. Because debris buildup in the shaver head can inhibit movement of the shaver head components, failing to regularly clean the shaver head tends to detract from the cutting effectiveness of the shaver head, which could lead to a less than desirable shaving experience.

There is a need, therefore, for an efficient and user-friendly system for cleaning an electric shaver.

SUMMARY OF THE INVENTION

In one embodiment, a cleaning system for an electric shaver having a shaving head generally includes a housing having an interior space configured to retain cleaning fluid within the housing. The housing is further configured for supporting the shaver in a generally upright orientation with the shaving head of the shaver disposed at least in part within the interior space of the housing A displacement apparatus is disposed within the interior space of the housing and is selectively positionable within the housing between a first position in which the cleaning fluid within the housing defines a lower fluid level relative to the shaving head to be cleaned, and a second position in which the cleaning fluid defines a higher fluid level relative to the shaving head such that at the higher fluid level at least a portion of the shaving head of the shaver is submerged in the cleaning fluid within the housing.

In another embodiment, a cleaning system for an electric shaver having a body and a shaving head generally includes a housing having an interior space configured to contain cleaning fluid therein. The housing is further configured for supporting the shaver in a generally upright orientation with the shaving head of the shaver disposed at least in part within the interior space of the housing. A cleaning tray is disposed within the housing and is configured for retaining cleaning fluid therein, and a lifting apparatus is disposed within the housing and generally includes a lever and a fulcrum assembly on which the lever is pivotable. The tray is operatively connected to the lever for conjoint pivoting with the lever between a lowered position of the tray in which the tray is submerged in cleaning fluid within the housing in spaced relationship with the shaving head, and a raised position in which the tray is raised at least in part above the cleaning fluid in the housing while retaining some cleaning fluid within the tray. In the raised position of the tray, the tray is sufficiently positioned relative to the shaving head such that at least a portion of the shaving head is submerged in cleaning fluid in the tray.

In yet another embodiment, a cleaning system for an electric shaver having a body and a shaving head generally includes a housing having an interior space configured to contain cleaning fluid therein. The housing is further configured for supporting the shaver in a generally upright orientation with the shaving head of the shaver disposed at least in part within the interior space of the housing. A plunger is accessible exterior of the housing and extends into the interior space of the housing. The plunger is selectively positionable relative to the housing to manually raise the level of cleaning fluid within the housing for submerging at least a portion of the shaving head in the cleaning fluid.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
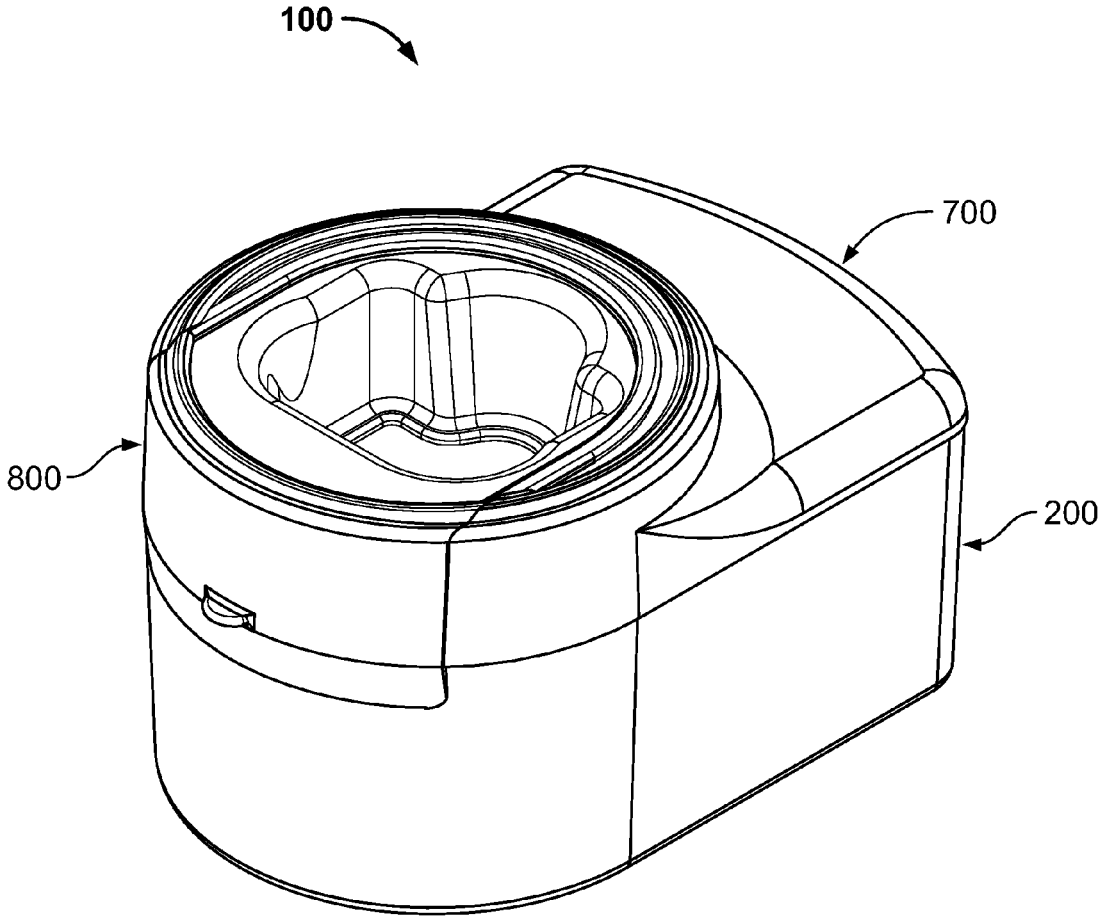
FIG. 1 is a perspective view of one embodiment of a cleaning system for an electric shaver.
Figure 2:
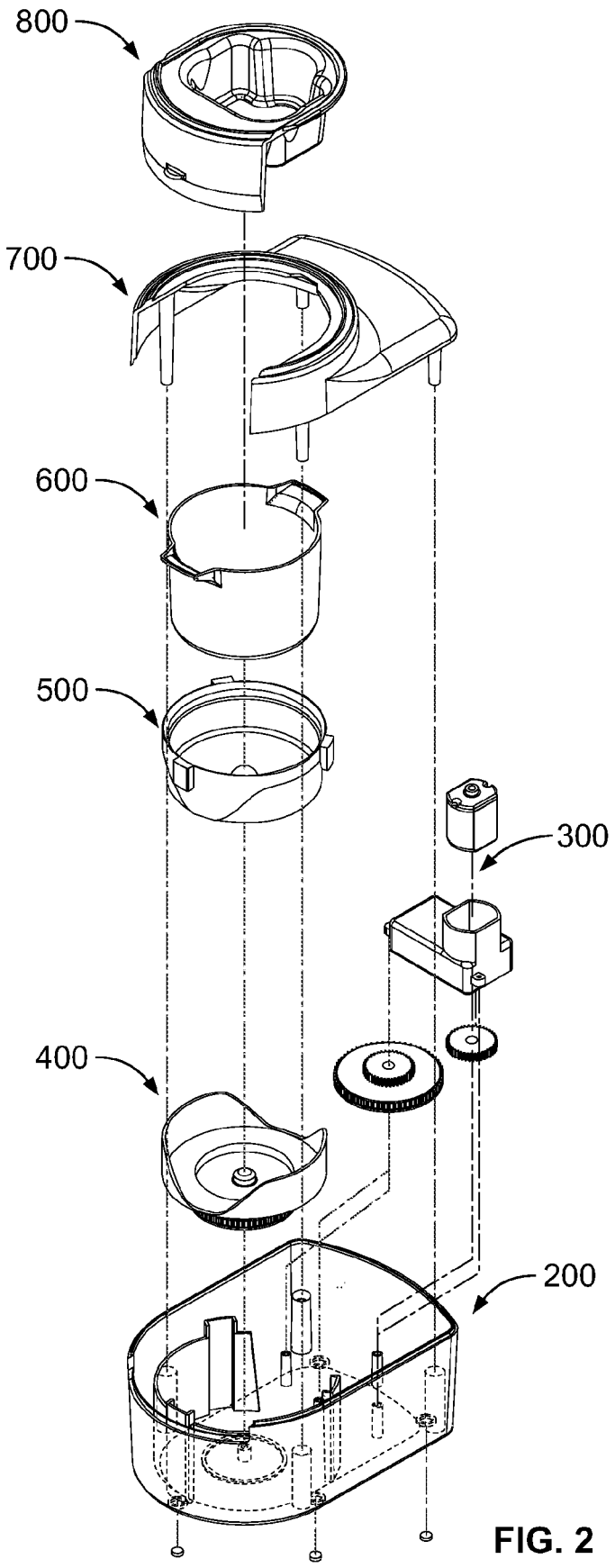
FIG. 2 is an exploded view of the cleaning system of FIG. 1.

Referring now to the drawings and, in particular, to FIG. 1, a cleaning system for an electric shaver according to one embodiment is indicated in its entirety by the reference numeral 100. The cleaning system 100 is illustrated in FIG. 1 in a fully assembled configuration (broadly referred to herein as the "assembled cleaning system") and in FIG. 2 in an exploded condition for illustrative purposes. The illustrated cleaning system 100 comprises a lower housing 200, a drive assembly 300, a cam 400, a follower 500, a reservoir 600, an upper housing 700, and a cover 800. One or more components of the cleaning system 100 may be suitably fabricated from a synthetic or semi-synthetic, organic-based material (e.g., a "plastic" material) using a molding process. It is understood, however, that the cleaning system 100 may be fabricated from any suitable material using any suitable manufacturing process without departing from the scope of this invention.

Figure 3:
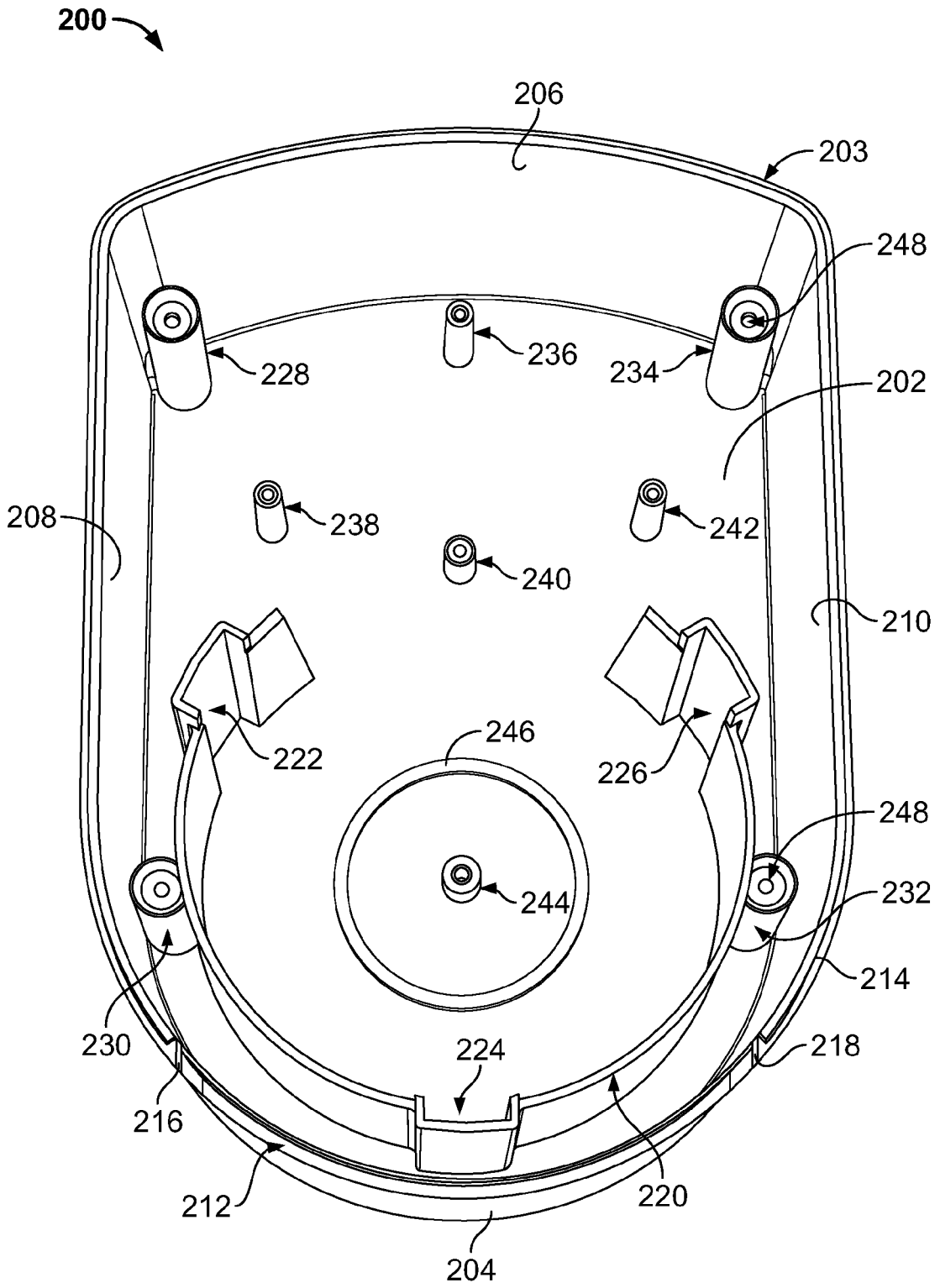
FIG. 3 is a perspective view of a lower housing of the cleaning system of FIG. 1.

As illustrated in FIG. 3, the lower housing 200 comprises a bottom wall 202 and a peripheral side wall 203 extending up from the bottom wall 202. In the illustrated embodiment, the peripheral side wall 203 suitably comprises a front wall 204, a rear wall 206, and opposite side walls 208, 210. The front and rear walls 204, 206 suitably have substantially arcuate contours, and the side walls 208, 210 suitably have substantially planar contours. In other embodiments, it is contemplated that the front wall 204, rear wall 206, and side walls 208, 210 may have any suitable contours. It is also understood that the lower housing 200 may be configured other than as illustrated. The illustrated lower housing 200 also has a notch 212 formed in the front wall 204 and a collar 214 that extends about the lower housing 200 from a first edge 216 of the notch 212 to a second edge 218 of the notch 212.

In the illustrated embodiment, the lower housing 200 also comprises a substantially arcuate sleeve 220 that is spaced inwardly from the front wall 204 and projects up from the bottom wall 202 to facilitate guiding the follower 500 and/or the reservoir 600 upward and downward during a cleaning operation, as described below. In other embodiments, it is contemplated that the sleeve 220 may have any suitable contour without departing from the scope of this invention. The illustrated sleeve 220 has guide channels 222, 224, 226 formed therein that suitably, but not necessarily, each have a U-shaped transverse cross-section. Optionally, a spacing of the first channel 222 from the second channel 224 is substantially equal to a spacing of the second channel 224 from the third channel 226 such that the first channel 222 opposes the third channel 226.

Suitably, the lower housing 200 also comprises housing assembly bosses 228, 230, 232, 234 and drive assembly bosses 236, 238, 240, 242, 244 projecting from the bottom wall 202. In other embodiments, the lower housing 200 may comprise any number of bosses that enables the lower housing 200 to function as described herein. With particular reference to drive assembly boss 244, the bottom wall 202 defines an annular groove 246 concentrically encircling the boss 244. Each of the illustrated housing assembly bosses 228, 230, 232, 234 and drive assembly bosses 236, 238, 240, 242, 244 has a core 248 that is sized to receive a boss pin. If the boss pin is threaded, it is also contemplated that each core 248 may likewise be threaded to engage the threaded boss pin without departing from the scope of this invention.

Figure 4:
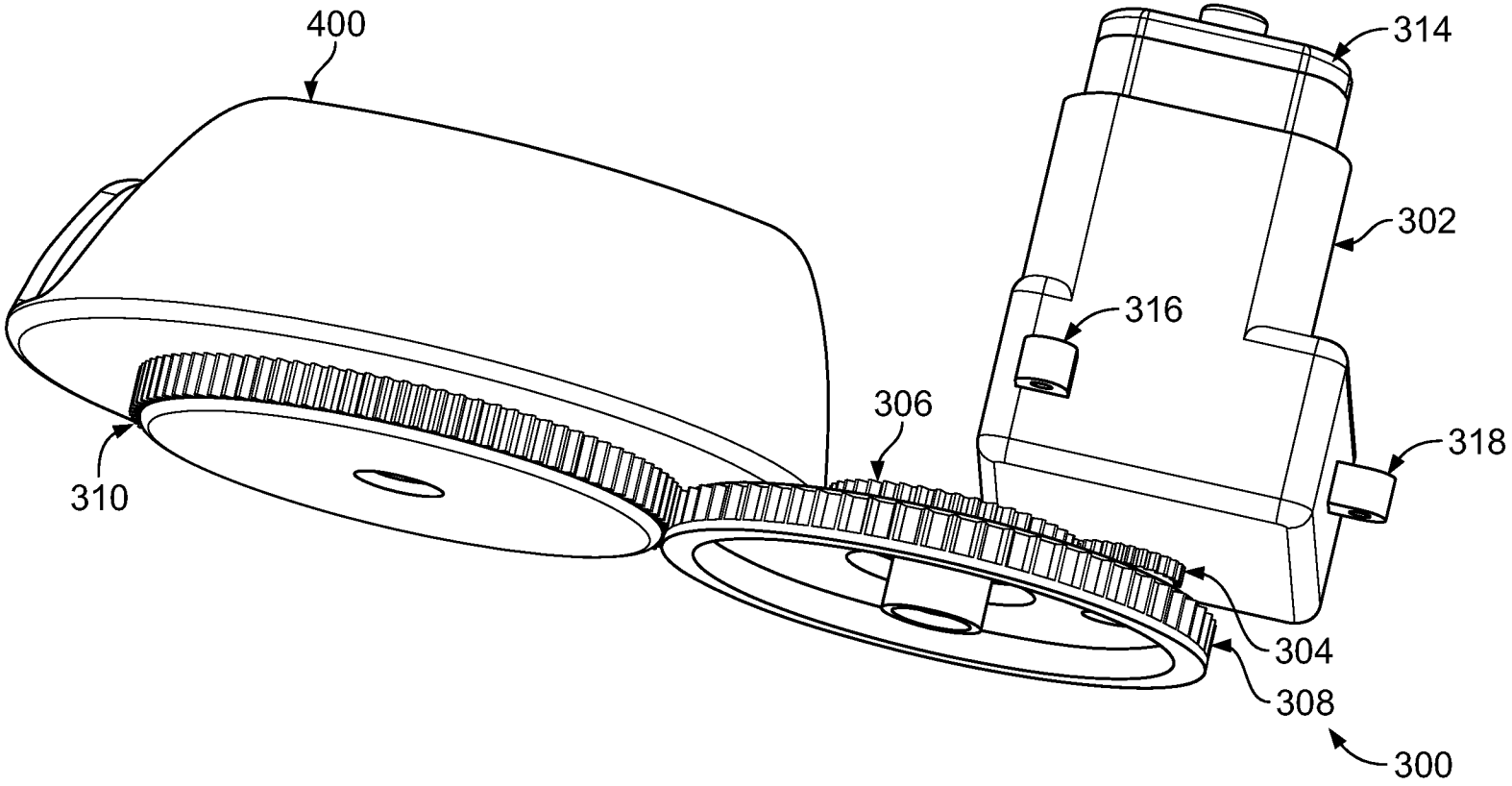
FIG. 4 is a perspective view of a drive assembly of the cleaning system of FIG. 1.
Figure 5:
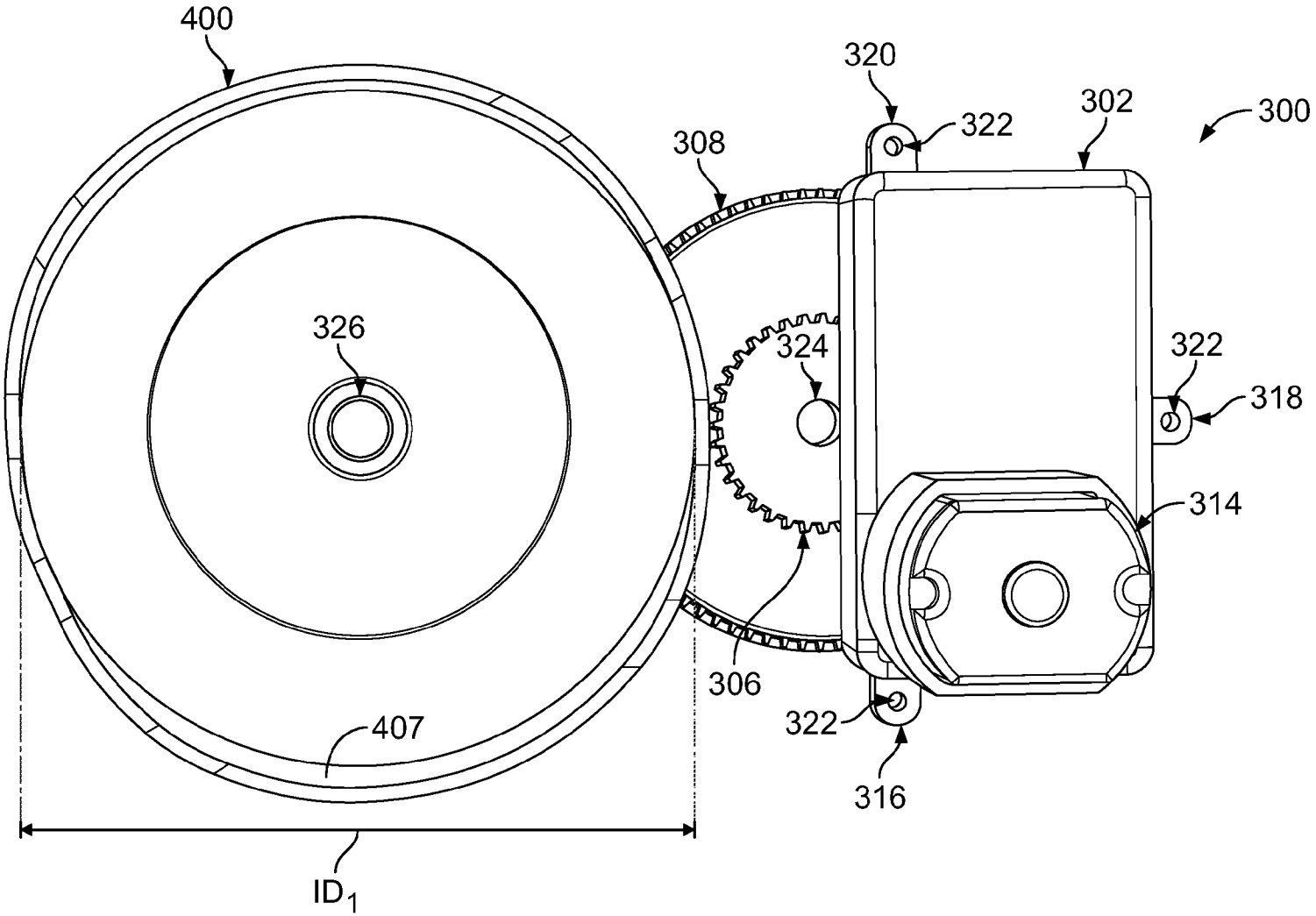
FIG. 5 is a plan view of the drive assembly of FIG. 4.

As illustrated in FIGS. 4 and 5, the drive assembly 300 of the system 100 suitably comprises a gear box 302 and suitable drive gears 304, 306, 308, 310. The gear box 302 at least in part houses a motor 314 and a gear reduction assembly operatively connected in driving engagement with the motor 314. As illustrated partially in FIG. 4 and fully in FIG. 5, the gear box 302 comprises multiple mounting tabs 316, 318, 320 that extend therefrom to facilitate mounting the gear box 302 on the drive assembly bosses 242, 236, 238, respectively. In the illustrated embodiment, the mounting tabs 316, 318, 320 are formed integrally with the gear box 302. In other embodiments, however, the mounting tabs 316, 318, 320 may be formed separate from and connected to the gear box 302 using any suitable fastener. Additionally, each of the illustrated mounting tabs 316, 318, 320 includes an eyelet 322 sized to receive one the boss pins therethrough to facilitate mounting the gear box 302 within the lower housing 200. It is contemplated that the eyelets 322 may be threaded and/or sized to receive various other suitable fasteners.

In the illustrated embodiment, the first gear 304 is drivingly connected to the gear reduction assembly housed within the gear box 302 such that actuation of the gear reduction assembly by the motor 314 induces rotation of the first gear 304. The second gear 306, which is fixedly connected to or formed with the third gear 308 in coaxial relationship therewith, is drivingly connected to the first gear 304 to operatively connect the second and third gears 306, 308 to the motor 314. The fourth gear 310, which is fixedly connected to or formed with the cam 400, is drivingly connected to the third gear 308 such that rotation of the third gear 308 induces rotation of the cam 400 via the fourth gear 310.

Suitably, the second and third gears 306, 308 have a central bore 324 therethrough, with the bore 324 being sized to receive the third drive assembly boss 240 of the lower housing 200 to facilitate rotatably mounting the second and third gears 306, 308 on the lower housing 200. Similarly, the fourth gear 310 and the cam 400 have a central bore 326 therethrough, with this bore 326 being sized to receive the fifth drive assembly boss 244 of the lower housing 200 to facilitate rotatably mounting the fourth gear 310 and the cam 400 on the lower housing 200. In other embodiments, the cam 400 may be operatively connected to the motor 314 via any suitable number of gears having any suitable size. Alternatively, the cam 400 may be directly and operatively connected to the motor 314 for rotation of the cam 400 relative to the lower housing 200.

Figure 6:
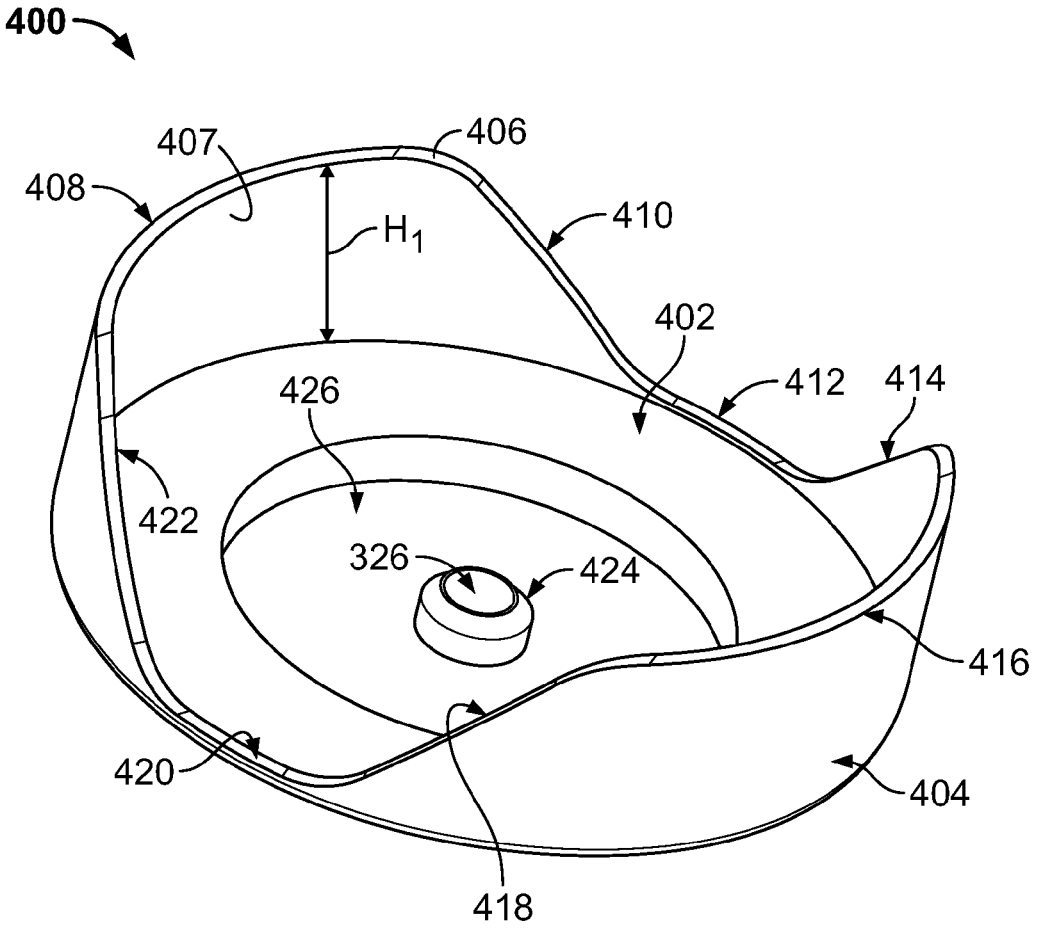
FIG. 6 is a perspective view of a cam of the cleaning system of FIG. 1.

With reference to FIG. 6, the cam 400 comprises a base 402 and an annular wall 404 extending up from the base 402. The upper edge, or rim, of the cam wall 404 defines a cam surface 406 and the inner face 407 of the wall 404 defines a first transverse dimension (e.g., an inner diameter $ID_1$) (FIG. 5) of the cam 400. Suitably, the cam 400 also comprises a central hub 424 projecting from a recessed portion 426 of the base 402 and defining the second bore 326. Additionally, the cam surface 406 of the illustrated embodiment defines a height $H_1$ from the base 402 that varies about the wall 404 circumference to define a cam path having a first peak 408, a first slope 410, a first valley 412, a second slope 414, a second peak 416, a third slope 418, a second valley 420, and a fourth slope 422. It is contemplated that the wall 404 may have any number of peaks, valleys, and/or slopes to suit any desirable cleaning cycle of the system 100, as described below. As used herein, the term "diameter" refers to a distance across any cross-sectional shape (e.g., a rectangle, a triangle, etc.) and is not limited to referring only to a distance across circular or elliptical cross-sectional shapes.

Figure 7:
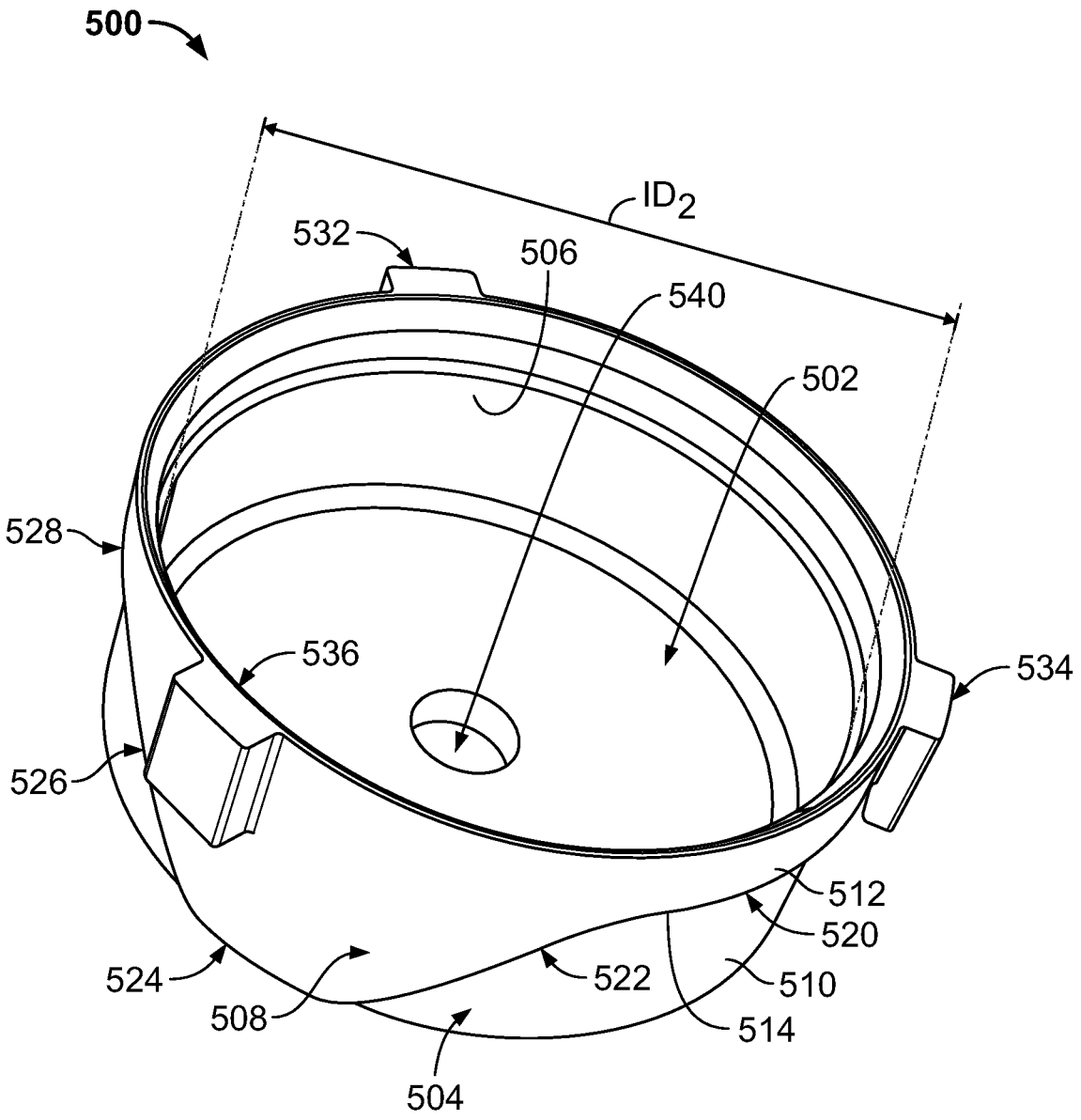
FIG. 7 is a top perspective view of a follower of the cleaning system of FIG. 1.
Figure 8:
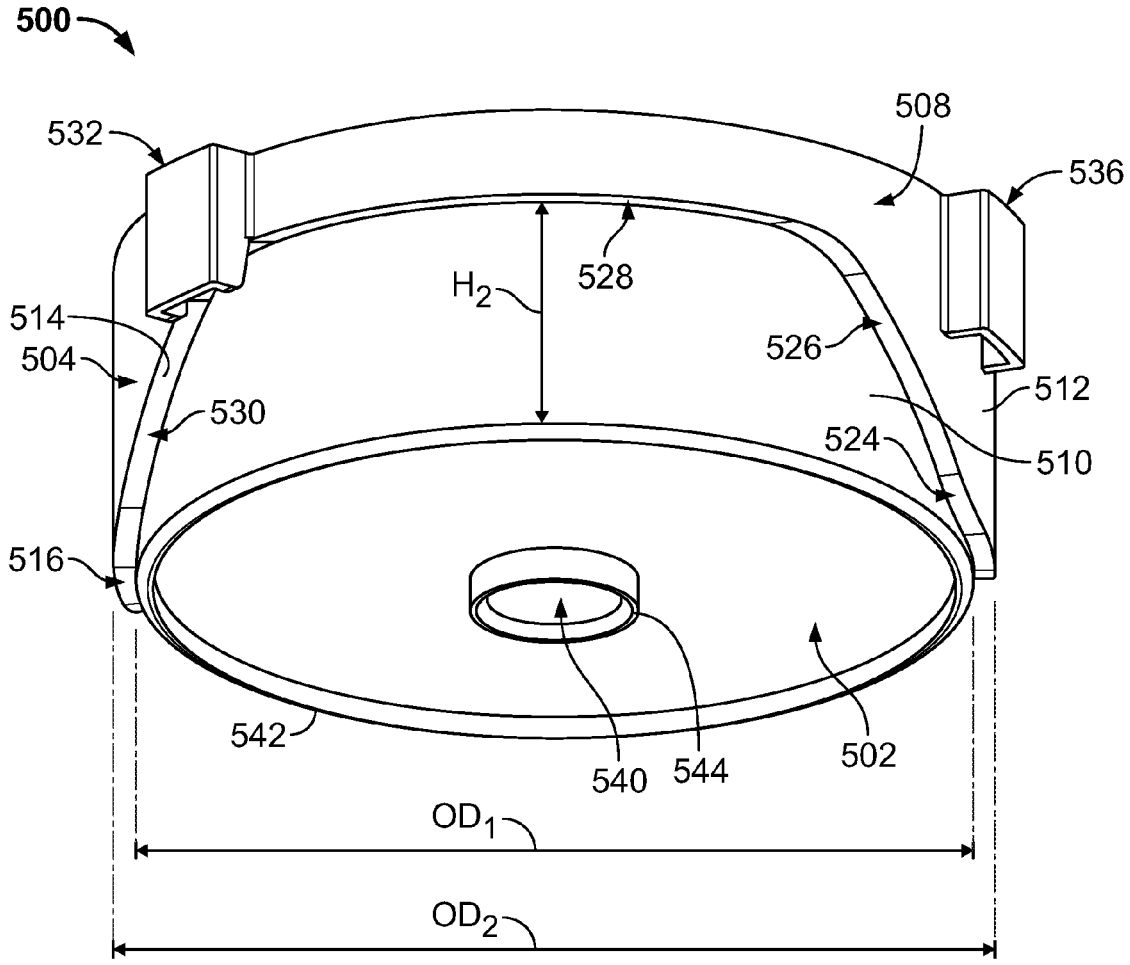
FIG. 8 is a bottom perspective view of the follower.

As illustrated in FIGS. 7 and 8, the follower 500 comprises a base 502 and an annular wall 504 extending up from the base 502. Suitably, the base 502 has a central bore 540 sized to receive the hub 424 (FIG. 6) of the cam 400 to seat the follower 500 on the cam 400 while allowing rotation of the cam 400 relative to the follower 500. The illustrated base 502 comprises an inner seat 544 that depends from the base 502 concentrically about the bore 540. The base 502 also comprises an annular seat 542 that depends from the base 502 adjacent the peripheral edge of the follower base 502.

The illustrated follower wall 504 has an inner surface 506 and an outer surface 508. The inner surface 506 suitably defines a second transverse dimension (e.g., an inner diameter $ID_2$), and the outer surface 508 suitably has a first portion 510 having a third transverse dimension (e.g., a first outer diameter $OD_1$) and a second portion 512 having a fourth transverse dimension (e.g., a second outer diameter $OD_2$ that is greater than the first outer diameter $OD_1$). The first portion 510 intersects the second portion 512 to define a follower surface 514. In the illustrated embodiment, the first outer diameter $OD_1$ is sized to facilitate the follower 500 being inserted into the cam 400 such that the first portion 510 is seated against the inner surface 407 of the annular wall 404 of the cam 400 with the follower surface 514 seated on the cam surface 406. Without departing from the scope of this invention, it is also contemplated that the first outer diameter $OD_1$ may be sized such that the first portion 510 is not seated against the wall 404 but, rather, is spaced apart from the wall 404 when the follower 500 is inserted into the cam 400 as long as the follower 400 includes a follower surface 514 in contact with the cam surface 406 of the cam 400.

Suitably, the follower surface 514 has a height $H_2$ that varies about the circumference of the wall 504 to define a first peak 516, a first slope (not shown), a first valley 520, a second slope 522, a second peak 524, a third slope 526, a second valley 528, and a fourth slope 530. In the illustrated embodiment, the peaks 516, 524 of the follower 500 are sized to correspond with each of the valleys 420, 412 of the cam 400, and the valleys 520, 528 of the follower 500 are sized to correspond with each of the peaks 408, 416 of the cam 400 such that substantially all of follower surface 514 can be seated against the cam surface 406 when the follower 500 is inserted into the cam 400. However, it is also contemplated that the wall 504 of the follower 500 may have any suitable configuration that enables the follower 500 to function as described herein.

In the illustrated embodiment, the follower 500 further comprises guides 532, 534, 536 formed with and extending outwardly from the wall 504 in circumferentially spaced relationship with each other. The guides 532, 534, 536 of the illustrated follower 500 each have a substantially U-shaped cross-section to facilitate insertion of the guides 532, 534, 536 into the channels 222, 224, 226 of the sleeve 220. In other embodiments, it is contemplated that the guides 532, 534, 536 may have any suitable configuration and arrangement to enable the guides 532, 534, 536 to function with the channels 222, 224, 226 as described herein.

Figure 9:
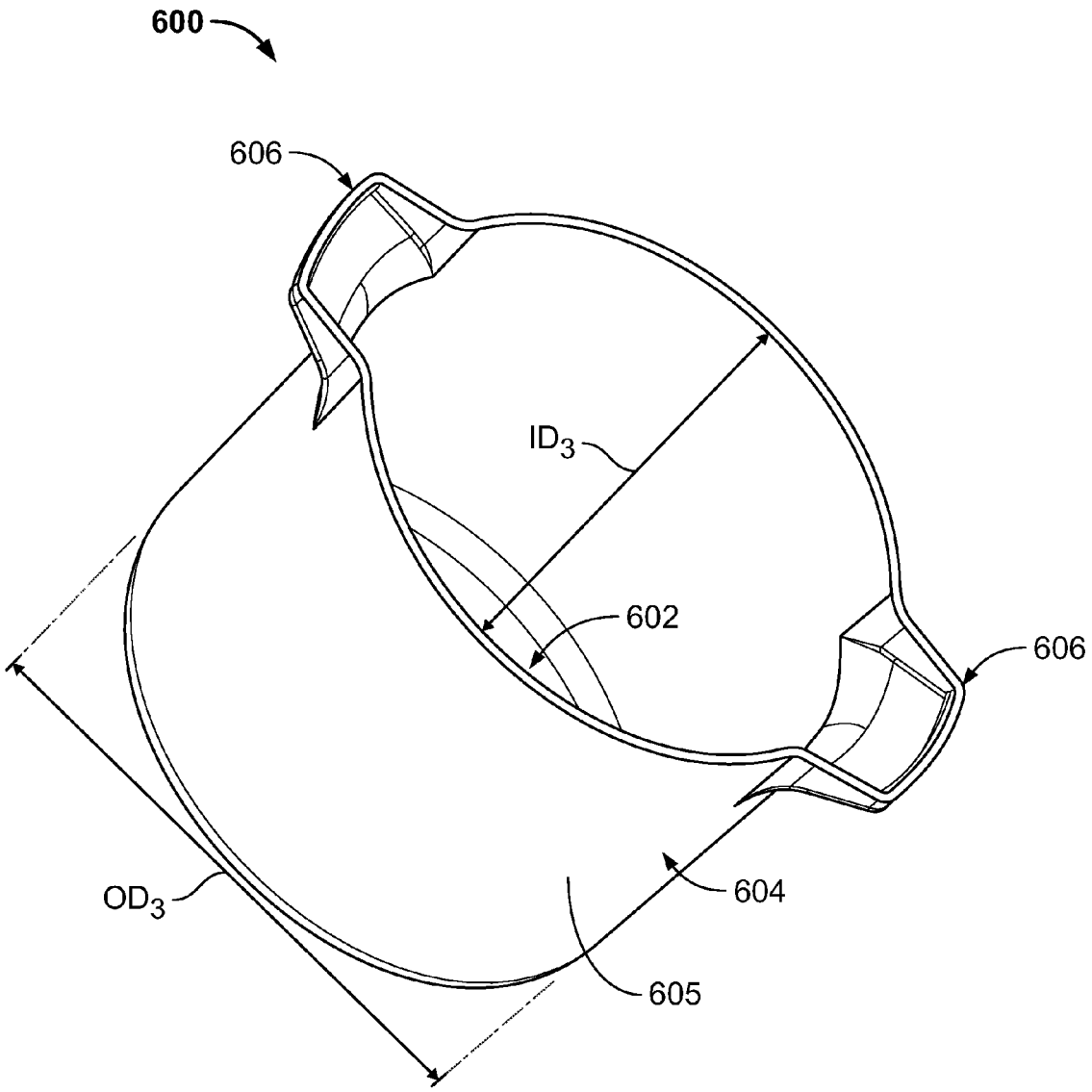
FIG. 9 is a perspective view of a reservoir of the cleaning system of FIG. 1.

The reservoir 600, with reference to FIG. 9, has a substantially cylindrical contour and comprises a bottom 602 and a sidewall 604. The illustrated reservoir 600 has a sixth transverse dimension (e.g., an inner diameter $ID_3$) and a seventh transverse dimension (e.g., an outer diameter $OD_3$) that is sized to facilitate inserting the reservoir 600 into the follower 500 with an outer surface 605 of the sidewall 604 in closely spaced or contact relationship with the inner surface 506 of the follower wall 504, thereby stabilizing the reservoir 600 within the follower 500. The reservoir 600 may also suitably comprise a pair of handles 606 that extend transversely outward from the sidewall 604 which the user may grasp when removing the reservoir 600 from or inserting the reservoir 600 into the follower 500. In one embodiment, the reservoir 600 may be integrally formed with the follower 500 (i.e., the follower surface 514 may be formed on the sidewall 604 of the reservoir 600).

Figure 10:
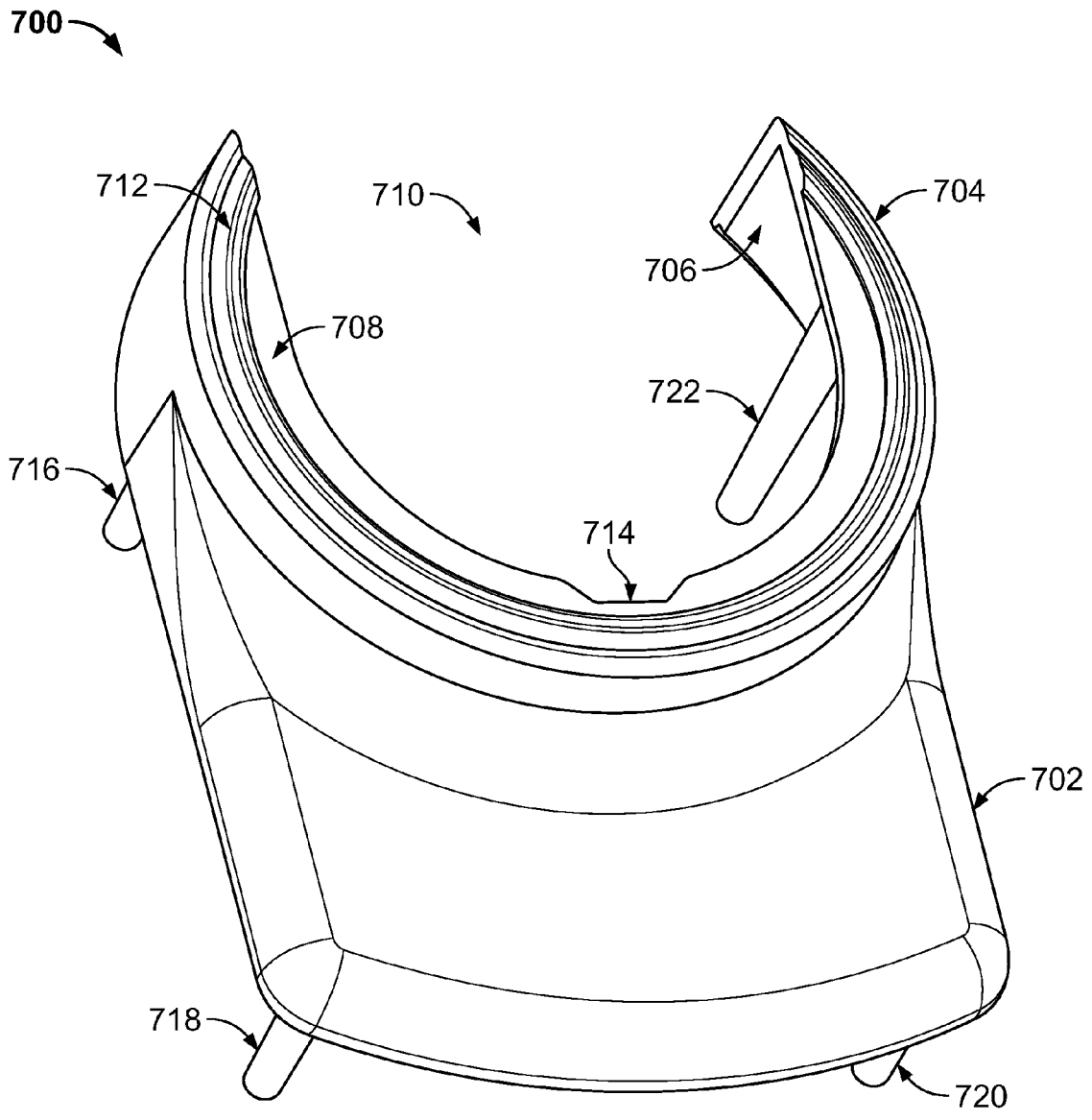
FIG. 10 is a perspective view of an upper housing of the cleaning system of FIG. 1.

Referring now to FIG. 10, the upper housing 700 comprises a cover region 702 and an access region 704. The access region 704 comprises a rear wall 706 and a rim 708 that defines an inlet 710, an arcuate lip 712, and a notch 714. In the illustrated embodiment, the upper housing 700 also comprises first, second, third, and fourth studs 716, 718, 720, 722 projecting therefrom. Suitably, each of the illustrated studs 716, 718, 720, 722 is hollow and/or threaded to facilitate receiving one of the boss pins therein and to facilitate mounting the upper housing 700 on the lower housing 200. Without departing from the scope of this invention, it is contemplated that the access region 704 may have any suitable contour that enables the upper housing 700 to function as described herein.

Figure 11:
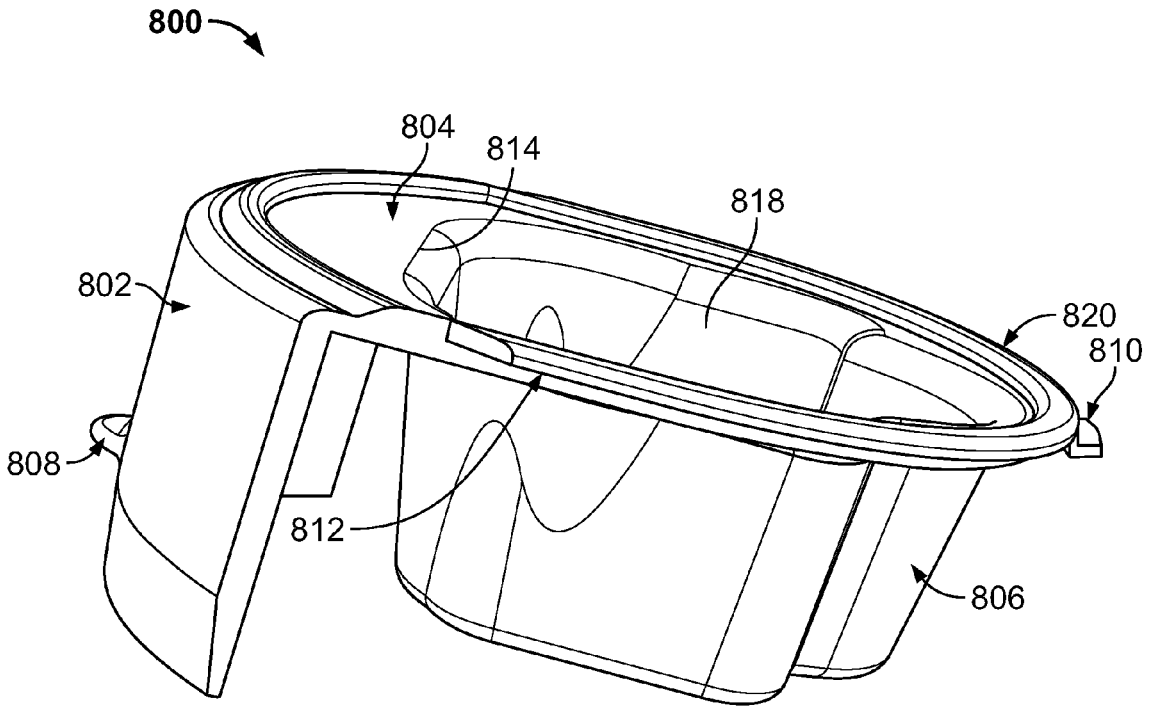
FIG. 11 is a perspective view of a cover of the cleaning system of FIG. 1.
Figure 12:
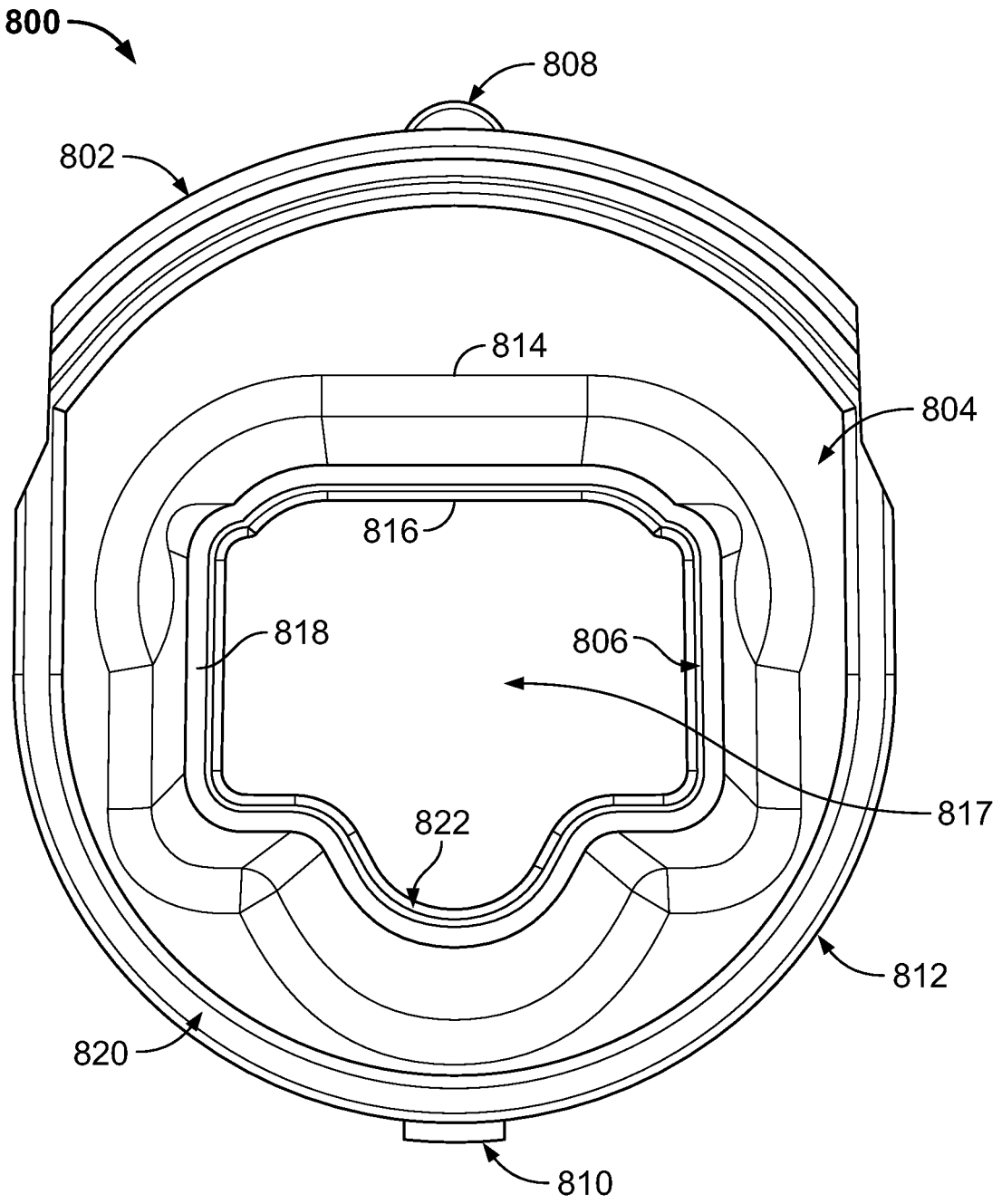
FIG. 12 is a top plan view of the cover of FIG. 11.

As illustrated in FIGS. 11 and 12, the cover 800 comprises a rear panel 802, a top panel 804, and a cradle 806. In the illustrated embodiment, the rear panel 802 comprises a first tab 808 extending outward therefrom to facilitate a user grasping the cover 800, and the top panel 804 comprises a second tab 810 that extends outwardly therefrom to facilitate connecting the cover 800 to the upper housing 700 as described below. Additionally, the top panel 804 has an annular contour, defines a lip 812 that is sized to be seated on the rim 708 of the upper housing 700, and defines an arcuate ridge 820 that substantially circumscribes the cradle 806.

The illustrated cradle 806 is sized for disposition at least in part down in the reservoir 600 and comprises an upper edge 814, a lower edge 816, and a sidewall 818 extending from the upper edge 814 to the lower edge 816. The illustrated sidewall 818 is sized to receive the head of a shaver and extends substantially perpendicular to a surface of the top panel 804 to facilitate inhibiting the shaver from tipping over during a cleaning operation. Also, the cradle 806 comprises a shoulder 822 that projects inwardly from the sidewall 818 to the lower edge 816 to define a cleaning fluid port 817 and to facilitate inhibiting the shaver from falling into a cleaning fluid in the reservoir 600 during a cleaning operation. In one embodiment, the cradle 806 (e.g., the shoulder 822) is configured to orient the head of the shaver at an angle (e.g., at about 15° or 20°) relative to a fluid level within the reservoir 600 to facilitate draining residual cleaning fluid from within the shaver head after a cleaning operation, as described below. Suitably, the sidewall 818 has a cross-sectional shape that enables a shaver head having either a substantially rectangular cross-section (e.g., a foil shaver) or a substantially triangular cross-section (e.g., a rotary shaver) to be inserted into and supported by the cradle 806. In other embodiments, it is contemplated that the sidewall 818 may have any suitable cross-sectional shape and/or contour that enables the cradle 806 to function as described herein. Alternatively, the cradle 806 may comprise a closure (e.g., a hinged door, a cap, etc.) for use in covering the port 817 to facilitate preventing the cleaning fluid from evaporating and/or preventing external objects (e.g., a toothbrush), particulates (e.g., dust), and/or fluids (e.g., hairspray) from entering the port 817 when the system 100 is not in use.

Figure 13:
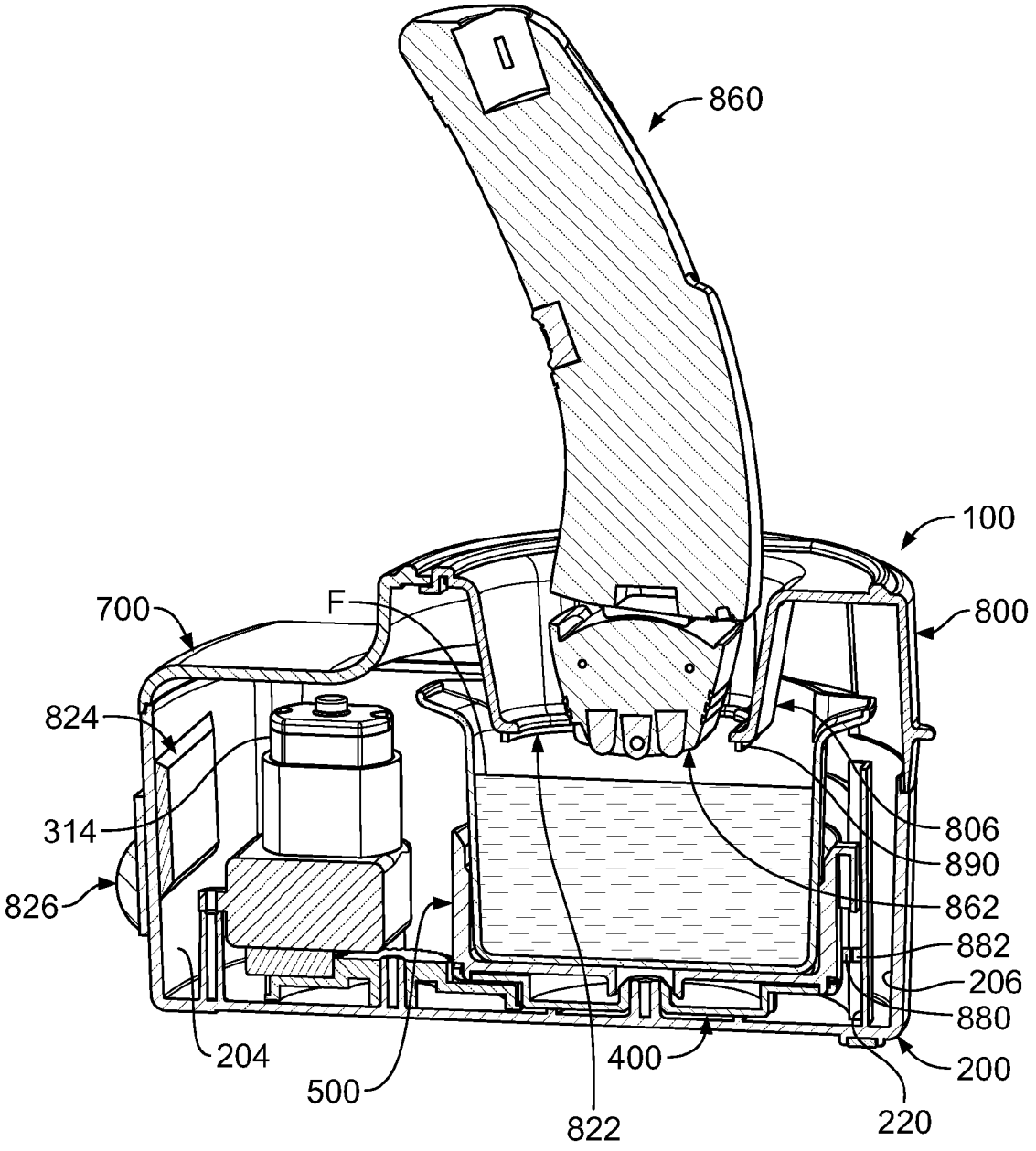
FIG. 13 is a section of the cleaning system of FIG. 1 with a shaver inserted therein and the reservoir in a lowered position.
Figure 14:
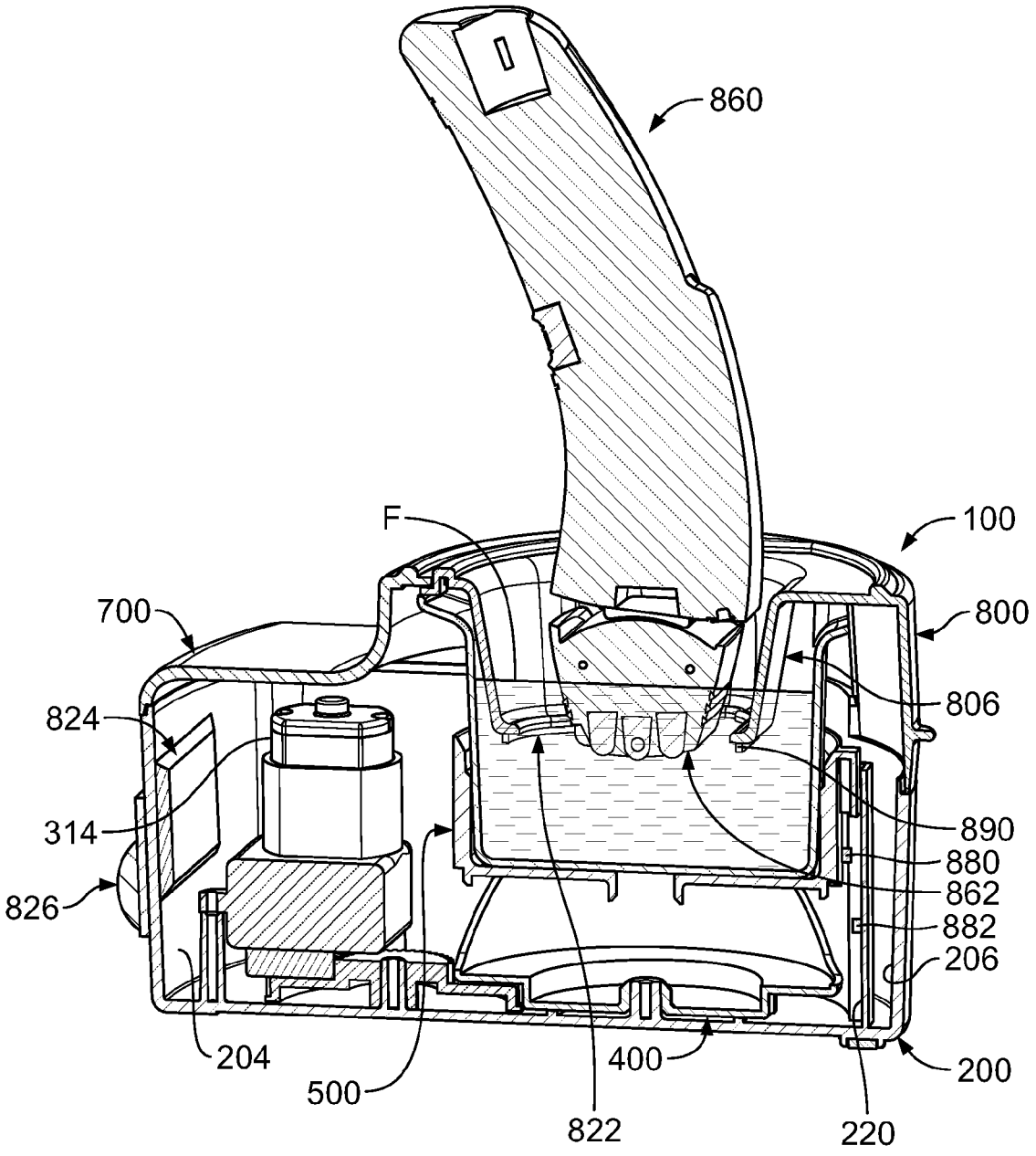
FIG. 14 is a section of the cleaning system of FIG. 1 with a shaver inserted therein and the reservoir in a raised position.

FIGS. 13-14 illustrate the cleaning system 100 fully assembled and with a shaver 860 held by the system 100 for cleaning. The cleaning system 100 further comprises a control unit 824 mounted at any suitable location on the system housing (e.g., on either the front wall 204 or the rear wall 206 of the lower housing 200). The illustrated control unit 824 comprises a controller, a memory, a user interface, and at least one sensor positioned within the cleaning system 100 (e.g., proximate drive assembly 300, cam 400, and/or follower 500). As used herein, the term "controller" refers to any suitable processor-based or microprocessor-based control system. In other embodiments, the control unit 824 may be any suitable electrical system that controls an operation of the system 100. In alternative embodiments, the system 100 may be configured for manual operation by a user (e.g., via a manually operated slide or dial that facilitates rotating the cam 400).

In some embodiments, the user interface comprises a mechanical slide, a push-button 826, a display screen, and/or any other device that enables a user to interact with the control unit 824, as described herein. If the user interface includes a display screen, the display screen may utilize various display technologies, including, but not limited to, liquid crystal display (LCD), plasma, cathode ray tube (CRT), or analog-type display technologies, for example.

In one embodiment, the sensor includes a contact pin 880 and a contact surface 882 (e.g., a limit switch). Suitably, the contact pin 880 may be fixed to the follower 500, the cam 400, and/or the drive assembly 300 (e.g., to either the first gear 304, the second gear 306, the third gear 308, and/or the fourth gear 310), and the contact surface 882 may be fixed to the lower housing 200 (e.g., the sleeve 220) such that the contact pin 880 can engage the contact surface 882 during a rotation of the follower 500, the cam 400, and/or the drive assembly 300. Alternatively, the contact pin 880 may be fixed to the follower 500, and the contact surface 882 may be fixed to the cam 400, such that the contact pin 880 engages the contact surface 882 when the follower 500 engages the cam 400 as described below.

In another embodiment, the control unit 824 may be operatively connected to a suitable agitator 890 (e.g., an ultrasonic transducer) fixed to either the cradle 806, the reservoir 600, and/or any other suitable location within the system 100 to facilitate agitating either the shaver head 862 and/or the cleaning fluid when the shaver head 862 is at least partially submerged within the cleaning fluid, as described below.

The illustrated control unit 824 is programmed to receive data relating to a desired cleaning operation from either a user (i.e., via the user interface), from the motor 314, from the sensor, and/or from the agitator 890; to selectively operate the motor 314 and/or the agitator 890 in accordance with a desired cleaning operation; to generate data relating to a status of the desired cleaning operation (e.g., an amount of time remaining in the desired cleaning operation); to display to the user (i.e., via the user interface) information relating to the status of the desired cleaning operation; and/or to store in the memory at least one record relating to data received from either the user, the motor 314, the sensor, the agitator 890 and/or any other component of the system 100.

The illustrated system 100 (e.g., the control unit 824 and/or the motor 314) may be powered using any suitable power source, across any suitable medium, such as battery power or hardwiring, for example. Alternatively, the system 100 may include a power connector (e.g., a power cable extending from the upper housing 700) for use in electrically connecting the shaver 860 to the system 100 to facilitate either charging and/or operating the shaver 860 during a cleaning operation and/or to facilitate operating the system 100 via a battery housed within the shaver 860.

In one embodiment of a method of making the cleaning system 100, the second and third gears 306, 308 are mounted in the lower housing 200 such that the third drive assembly boss 240 is inserted into the bore 324. The fourth gear 310 and the cam 400 are then mounted within the sleeve 220 of the lower housing 200 such that the fifth drive assembly boss 244 is inserted into the bore 326. The motor 314 is inserted into the pocket of the gear box 302, and the first gear 304 is connected to the gear reduction assembly housed within the gear box 302. The motor 314, the gear box 302, and the first gear 304 are then mounted within the lower housing 200 such that the first gear 304 is in driving engagement with the second gear 306. Specifically, the gear box 302 is mounted within the lower housing 200 by seating the mounting tabs 316, 318, 320 on the respective drive assembly bosses 242, 236, 238 and by inserting a boss pin through each respective drive assembly boss 242, 236, 238 and each respective eyelet 322 of the mounting tabs 316, 318, 320.

After the drive assembly 300 and the cam 400 are mounted within the lower housing 200, the follower 500 is inserted into the sleeve 220 by sliding the first guide 532 into the first channel 222, by sliding the second guide 534 into the second channel 224, and by sliding the third guide 536 into the third channel 226. When the first, second, and third guides 532, 534, 536 slide down the first, second, and third channels 222, 224, 226, respectively, the follower 500 is received within the cam 400 such that the first and second peaks 408, 416 of the cam 400 correspond with the first and second valleys 520, 528 of the follower 500, respectively, to seat the follower surface 514 on the cam surface 406. When the follower surface 514 is seated on the cam surface 406, the hub 424 of the cam 400 is received within the third bore 540 of the follower 500, and the inner and outer seats 544, 542 of the follower 500 engage the base 402 of the cam 400 such that the inner seat 544 is positioned within the recessed portion 426 of the cam 400.

With the follower 500 seated in the cam 400, the reservoir 600 is inserted down into the follower 500 such that the bottom 602 of the reservoir 600 is seated on the base 502 of the follower 500 and such that the sidewall 604 of the reservoir 600 abuts the inner surface 506 of the follower 500. The upper housing 700 is then mounted on the lower housing 200 by seating the studs 716, 718, 720, 722 of the upper housing 700 on the corresponding housing assembly bosses 228, 230, 232, 234 of the lower housing 200, respectively, and by inserting the boss pins through the bottom wall 202 of the lower housing 200, into the cores 248 of the housing assembly bosses 228, 230, 232, 234, and into the studs 716, 718, 720, 722 of the upper housing 700.

With the upper housing 700 mounted on the lower housing 200, the cover 800 is connected to the upper housing 700. Specifically, the cover 800 is inserted into the inlet 710 such that the second tab 810 is received within the notch 714 of the upper housing 700, such that the lip 812 of the cover 800 rests on the rim 708 of the upper housing 700, and such that the rear panel 802 of the cover 800 covers the notch 212 of the lower housing 200. Suitably, the reservoir 600 is removable (e.g., to replace the cleaning fluid) by lifting the cover 800 away from the upper housing 700 via the first tab 808, by grasping the reservoir 600 via the handles 606, and by lifting the reservoir 600 through the inlet 710 of the upper housing 700.

Figure 15:
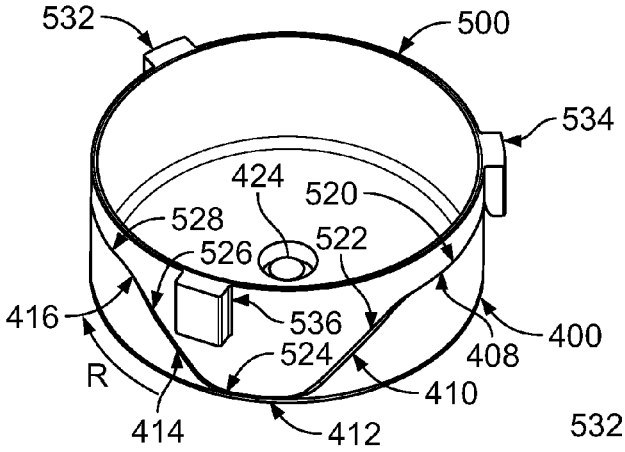
FIG. 15 is a perspective view of the follower of FIG. 7 nested in the cam of FIG. 6.

During a non-cleaning mode or cycle of the system 100, the follower 500 is positioned on the cam 400 (FIG. 15) such that the peaks 524, 516 of the follower 500 are seated in the valleys 412, 420, respectively, of the cam 400 and such that the valleys 520, 528 of the follower 500 are seated on the peaks 408, 416 of the cam 400, respectively. As such, the shaver head 862 of the shaver 860 is held, via the cradle 806, above the fluid level F in the reservoir 600.

With particular reference to FIGS. 13-17, the assembled cleaning system 100 operates in the following manner according to one embodiment of a method of cleaning an electric shaver. As used herein, the term "cleaning operation" refers to a predetermined number of cleaning cycles that are commensurate with a desired level of cleanliness. As used herein, the term "cleaning cycle" refers to a half rotation of the cam 400, which yields a soak period and a subsequent dwell period, as described below.

To initiate a desired cleaning operation of the system 100, a user inserts the shaver head 862 of a shaver 860 into the cradle 806, such that the shaver head 862 rests on the shoulder 822 of the cradle 806 and such that the cradle 806 supports the shaver 860 in an upright position. The user then enters data relating to a desired cleaning operation into the control unit 824 via the user interface (e.g., the user enters a unique actuation code into the control unit 824 via the push-button 826 mounted on the lower housing 200). After the user enters data into the control unit 824, the control unit 824 processes the data and actuates the motor 314 to perform a predetermined number of cleaning cycles to suit the desired cleaning operation.

During an exemplary cleaning operation, the system 100 performs two consecutive cleaning cycles in the following manner. The control unit 824 actuates the motor 314 to induce a clockwise rotation R of the cam 400 at a predetermined rate via the gear reduction assembly and the gears 304, 306, 308, 310, thereby disengaging the contact pin 880 from the contact surface 882. The channels 222, 224, 226 apply a biasing force against the guides 532, 534, 536 such that the follower 500 is prevented from rotating together with the cam 400, inducing the peaks 524, 516 of the follower 500 to slide up the slopes 410, 418, respectively, of the cam 400.

Figure 16:
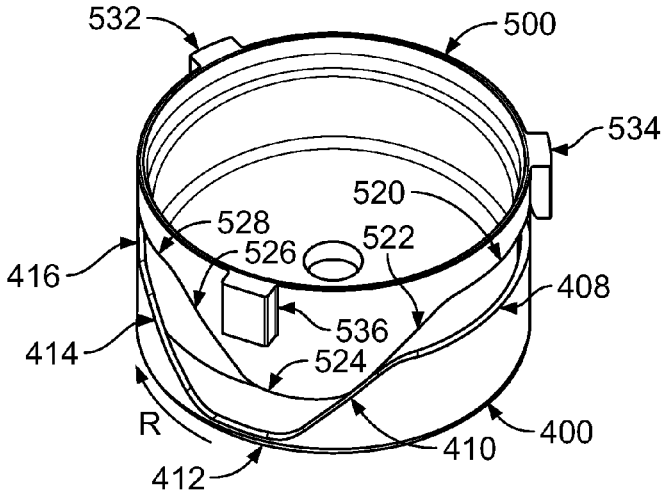
FIG. 16 is a perspective view similar to FIG. 15 with the cam rotated relative to the follower of FIG. 7.
Figure 17:
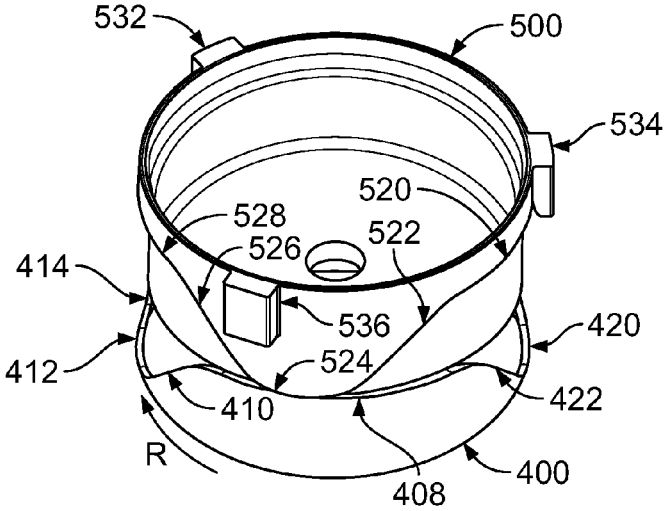
FIG. 17 is a perspective view similar to FIG. 16 with the cam further rotated relative to the follower of FIG. 7.
Figure 18:
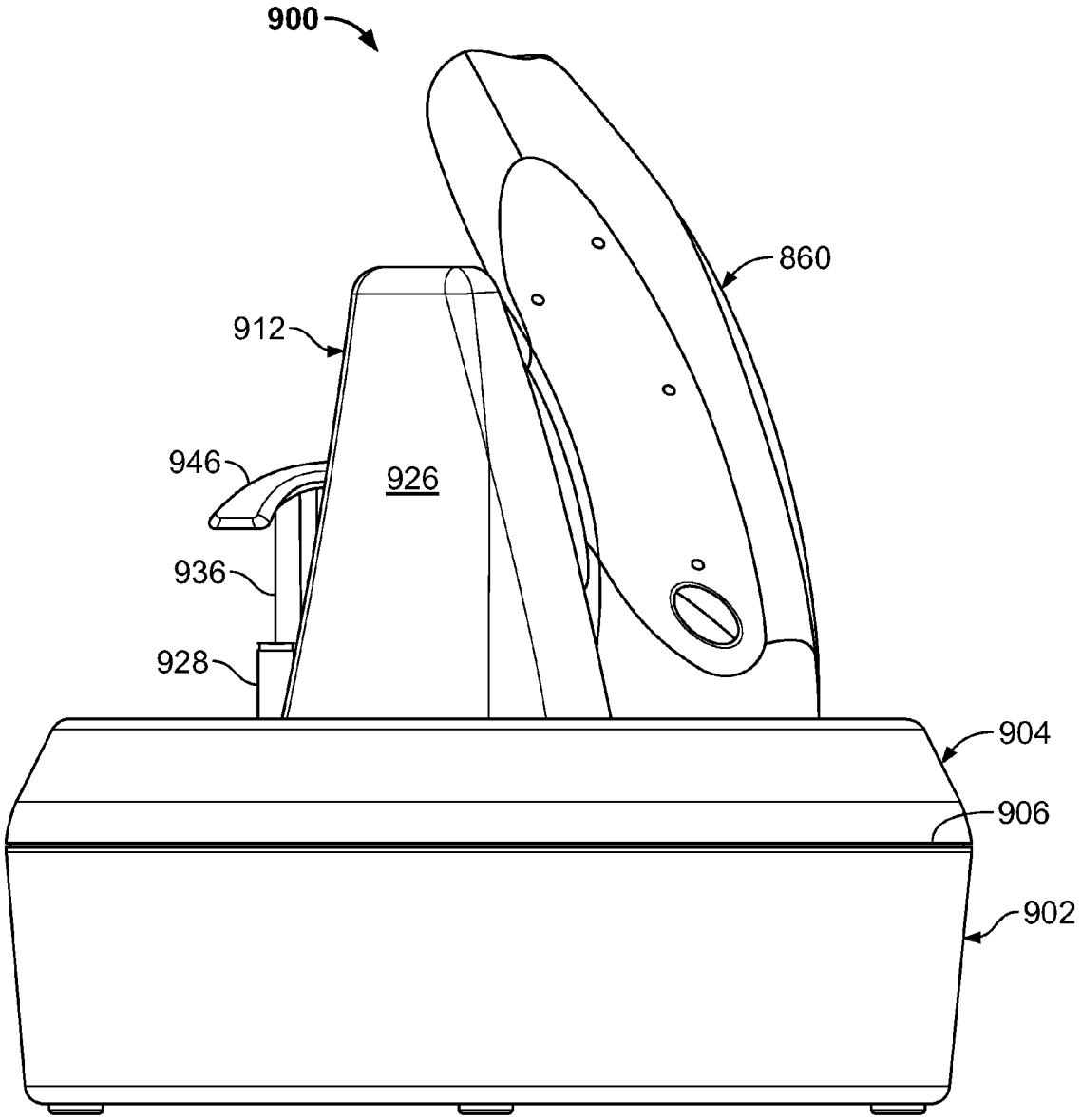
FIG. 18 is a side elevation of another embodiment of a cleaning system for an electric shaver.
Figure 19:
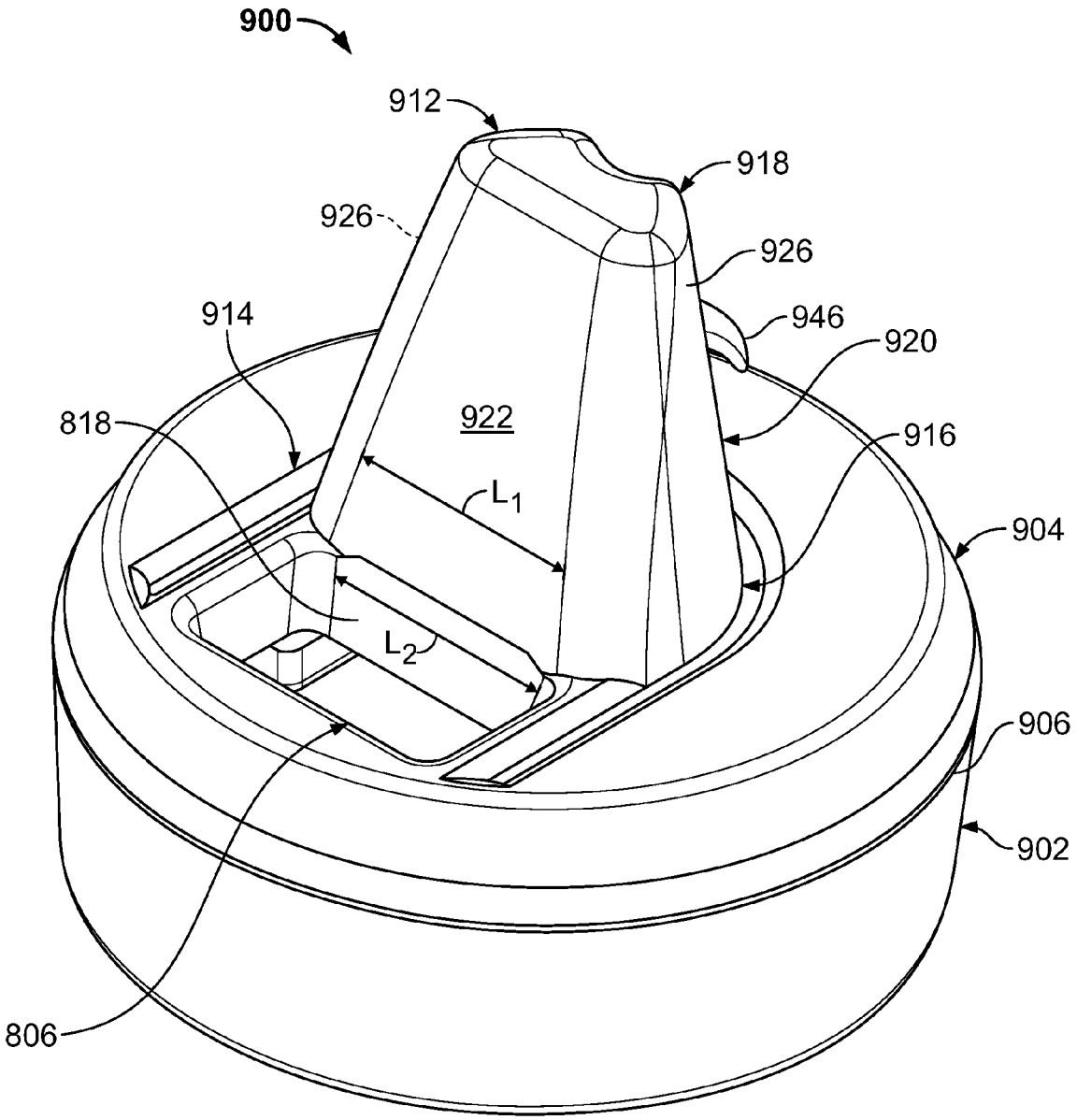
FIG. 19 is a perspective view of the cleaning system of FIG. 18.
Figure 20:
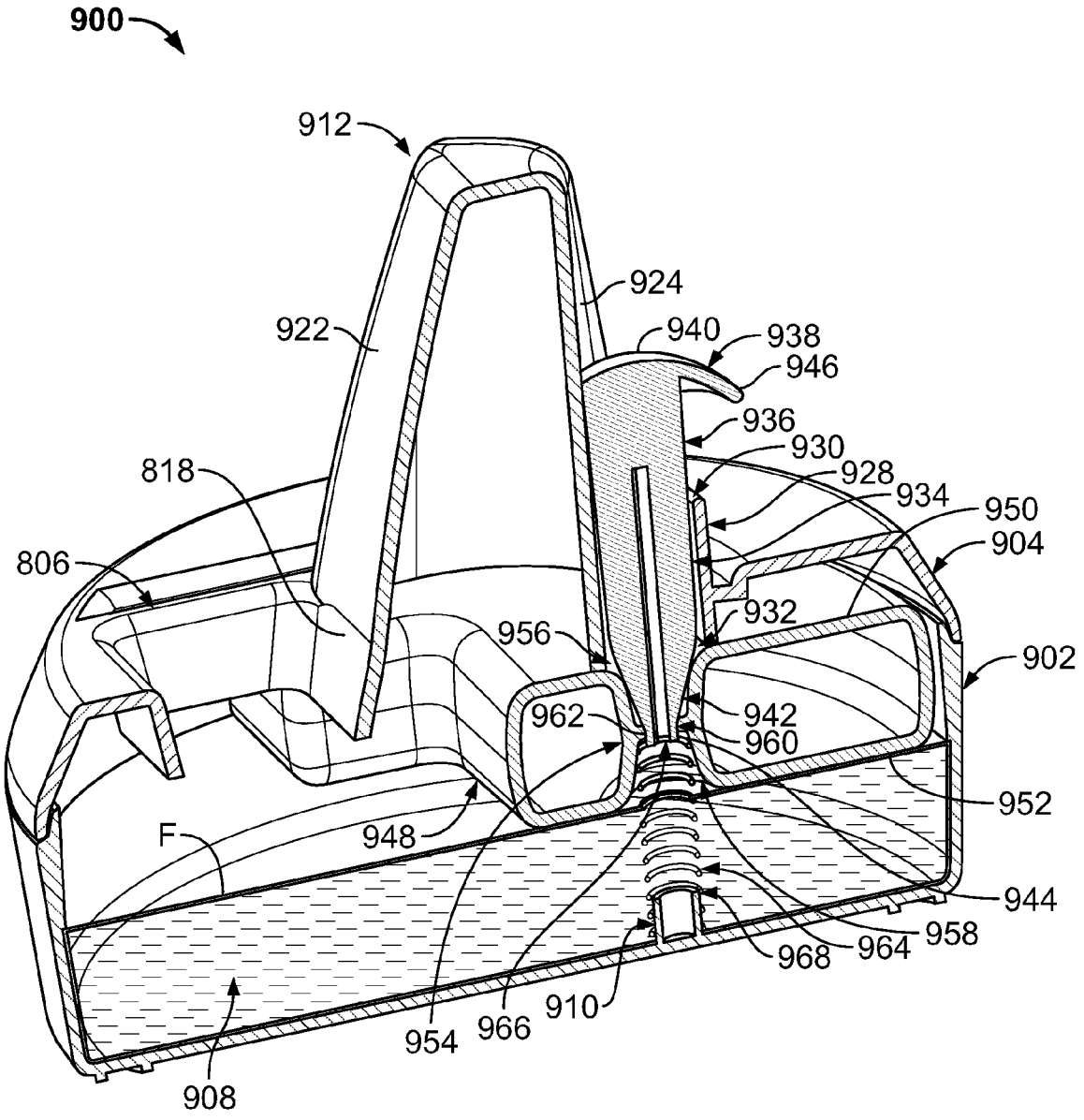
FIG. 20 is a section of the cleaning system of FIG. 18 with the cleaning fluid level lowered.
Figure 21:
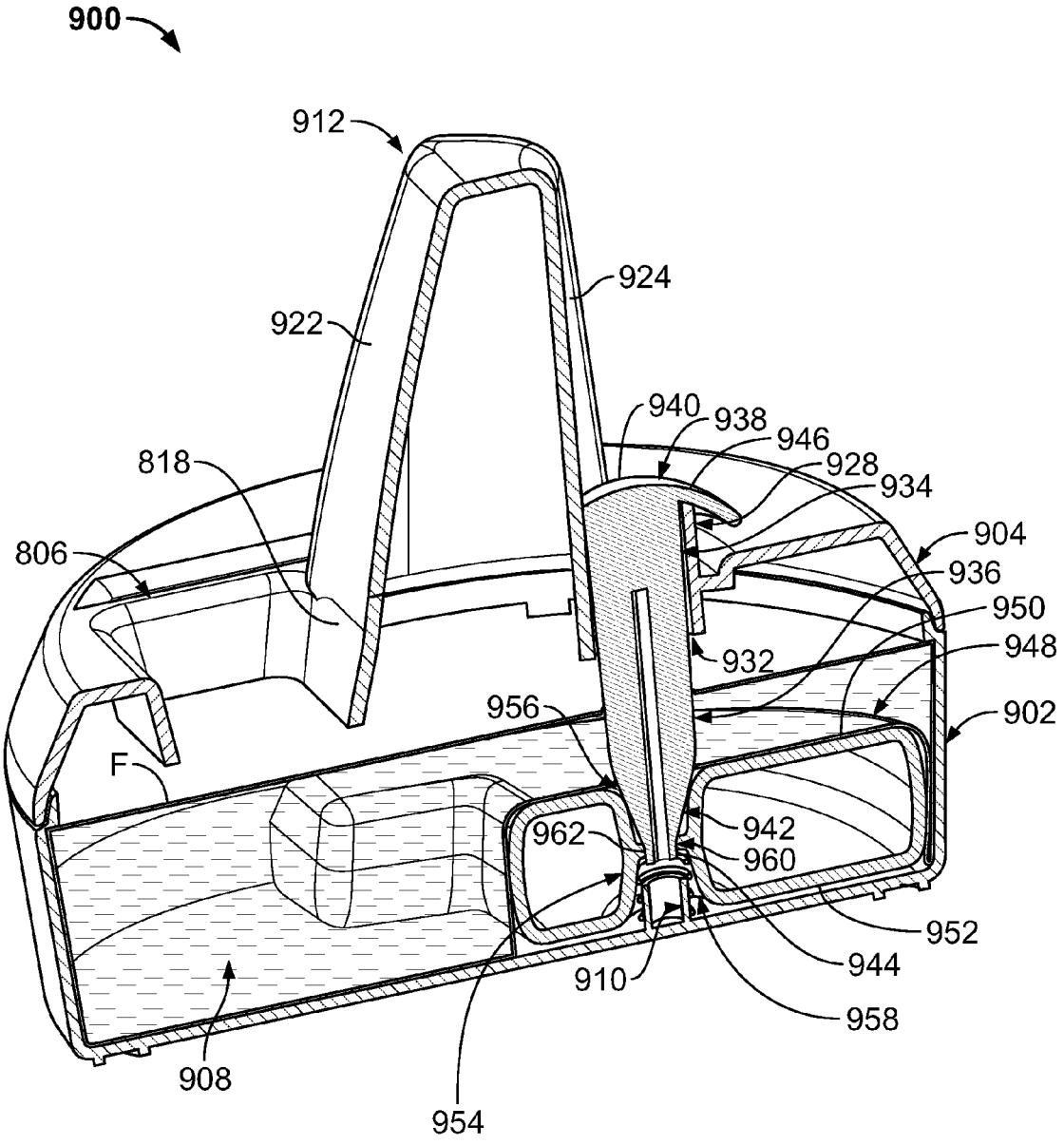
FIG. 21 is a section of the cleaning system of FIG. 18 with the cleaning fluid level raised.

When the peaks 524, 516 begin to slide up the slopes 410, 418 (e.g., as illustrated in FIG. 16), the guides 532, 534, 536 begin to slide up the respective channels 222, 224, 226 (i.e., inducing a first upward displacement of the follower 500). After the peaks 524, 516 have slid a predetermined distance up the slopes 410, 418 from the valleys 412, 420, respectively, the system 100 enters the first soak period. During the first soak period, the peaks 524, 516 slide completely up the slopes 410, 418, along the peaks 408, 416 of the cam 400, and a predetermined distance down the slopes 422, 414 of the cam 400, respectively, during which at least a portion of the cradle 806 and the shaver head 862 are submerged below the cleaning fluid level F in the reservoir 600 for a predetermined period of time (e.g., about one minute).

When the peaks 524, 516 begin to slide down the slopes 422, 414, the guides 532, 534, 536 begin to slide down the respective channels 222, 224, 226 (i.e., inducing a first downward displacement of the follower 500). After the peaks 524, 516 have slid the predetermined distance down the slopes 422, 414 from the peaks 408, 416, respectively, the system 100 enters the first dwell period. During the first dwell period, the peaks 524, 516 slide completely down the slopes 422, 414, along the valleys 420, 412 of the cam 400, and a predetermined distance up the slopes 418, 410 of the cam 400, respectively, during which the cradle 806 and the shaver head 862 are elevated above the cleaning fluid level F in the reservoir 600 for a predetermined period of time (e.g., about one minute) such that cleaning fluid flows out of the shaver head 862 and into the reservoir 600 carrying any dislodged buildup (e.g., particulates and/or oils).

When the peaks 524, 516 begin to slide up the slopes 418, 410, the guides 532, 534, 536 begin to slide up the respective channels 222, 224, 226 (i.e., inducing a second upward displacement of the follower 500). After the peaks 524, 516 have slid the predetermined distance up the slopes 418, 410 from the valleys 420, 412, respectively, the system 100 enters the second soak period. During the second soak period, the peaks 524, 516 slide completely up the slopes 418, 410, along the peaks 416, 408 of the cam 400, and a predetermined distance down the slopes 414, 422 of the cam 400, respectively, during which at least a portion of the cradle 806 and the shaver head 862 are again submerged below the cleaning fluid level F in the reservoir 600 for a predetermined period of time (e.g., about one minute).

When the peaks 524, 516 begin to slide down the slopes 414, 422, the guides 532, 534, 536 begin to slide down the respective channels 222, 224, 226 (i.e., inducing a second downward displacement of the follower 500). After the peaks 524, 516 have slid the predetermined distance down the slopes 414, 422 from the peaks 416, 408, respectively, the system 100 enters the second dwell period. During the second dwell period, the peaks 524, 516 slide completely down the slopes 414, 422 and mate with the valleys 412, 420 of the cam 400, during which the cradle 806 and the shaver head 862 are again elevated above the cleaning fluid level F in the reservoir 600 such that cleaning fluid flows out of the shaver head 862 and into the reservoir 600. Once the follower peaks 524, 516 mate with the cam valleys 412, 420, the contact pin 880 re-engages the contact surface 882, and the control unit 824 ceases to actuate the motor 314 (i.e., the cam 400 ceases to rotate and the cleaning operation is complete), such that cleaning fluid once again flows out of the shaver head 862 and into the reservoir 600 carrying more dislodged buildup (e.g., particulates and/or oils).

In the illustrated embodiment, the control unit 824 may be configured (e.g., programmed) to perform various different cleaning operations, each of which may include any suitable number of cleaning cycles. It is also contemplated that, in other embodiments, the cam 400 and/or the follower 500 may have any suitable number of peaks and/or valleys to suit any suitable number of soak periods and/or dwell periods per cleaning cycle.

FIGS. 18-21 illustrate a second embodiment of a cleaning system 900 similar to the system 100 (shown in FIGS. 1-17), with similar components identified in FIGS. 18-21 using the same reference numerals used in FIGS. 1-17. The illustrated system 900 comprises a lower housing 902 and an upper housing 904 that are generally annular and are connected together at a joint 906 to define a reservoir 908. The upper housing 904 comprises a cradle 806 that facilitates supporting a shaver 860, and the lower housing 902 comprises a spring seat 910 for supporting a biasing member 964, as described below. Optionally, a tower 912 may project from the upper housing 904, away from the reservoir 908, and adjacent to the cradle 806 to facilitate supporting the shaver 860 when the shaver 860 is seated in the cradle 806. A trough 914 is formed in the upper housing 904 about the periphery of the tower 912 and the cradle 806 to facilitate containment of cleaning fluid to an area proximate the cradle 806. In the illustrated embodiment, the cradle 806, the tower 912, and the trough 914 are formed integrally together. Alternatively, the cradle 806, the tower 912, and/or the trough 914 may be connected together using any suitable fastener.

The illustrated tower 912 comprises a base 916, an apex 918, and a tapered body 920 extending from the base 916 to the apex 918 such that the base 916 is wider than the apex 918. In the illustrated embodiment, the body 920 has a front face 922, a rear face 924, and a pair of peripheral faces 926. The illustrated front face 922 is substantially coplanar with, or tangent to, the sidewall 818 of the cradle 806 and has a length $L_1$ that is substantially equal to a length $L_2$ of the sidewall 818. Alternatively, the front face 922 may be oriented in any direction relative to the cradle 806, Suitably, the rear face 924 defines a cylinder 928 that extends from the upper housing 904, and the cylinder 928 comprises a first open end 930 and a second open end 932 and defines a passageway 934 from the first open end 930 through the second open end 932. In one embodiment, the body 920 may have any suitable shape. In another embodiment, the body 920 may have a shape that is contoured to substantially match a contour of the shaver 860.

In the illustrated embodiment, a plunger 936 is inserted into the reservoir 908 through the passageway 934 of the cylinder 928 such that the plunger 936 is slidable within the passageway 934 relative to the cylinder 928 (broadly, relative to the system housing). The illustrated plunger 936 comprises a first end region 938 proximate a first end 940 and a second end region 942 proximate a second end 944. Suitably, the first end region 938 defines a grip 946 accessible exterior of the system housing to enable a user to grasp the plunger 936, and the second end region 942 is tapered toward the second end 944 within the housing. In the illustrated embodiment, the grip 946 is sized substantially larger than the cylinder 928 such that the grip 946 contacts the cylinder 928 when the plunger 936 is depressed, thereby acting as a limit stop for the depression of the plunger 936. Suitably, the plunger 936 is lockable into a depressed position relative to the cylinder 928 via any suitable locking mechanism to facilitate maintaining an elevated cleaning fluid level F within the reservoir during a cleaning operation (e.g., the plunger 936 and/or the cylinder 928 may be sized such that an interference fit and/or a friction fit are generated between the plunger 936 and the cylinder 928 when the plunger 936 is slid upwardly and/or downwardly a predetermined distance within the cylinder 928).

Suitably, a fluid displacement apparatus 948 (e.g., a float in the illustrated embodiment) is operatively connected to the plunger 936 within the reservoir 908. The illustrated displacement apparatus 948 is hollow and has a generally arcuate contour. It is contemplated, however, that the displacement apparatus 948 may be solid and/or may have any suitable configuration without departing from the scope of this invention. In the illustrated embodiment, the displacement apparatus 948 comprises a top surface 950, a bottom surface 952, and a generally hourglass shaped bore 954 extending from the top surface 950 to the bottom surface 952. In the illustrated embodiment, the second end region 942 of the plunger 936 seats in an upper receptacle 956 portion of the bore 954 such that the plunger 936 is operatively connected to the displacement apparatus 948.

In the illustrated embodiment, a biasing member 964 (e.g., a spring) seats between the displacement apparatus 948 and the spring seat 910 to bias the plunger 936 toward its undepressed position (e.g., in a raised position).

In operation, a user places a shaver 860 in the system 900 such that the shaver head 862 of the shaver 860 is seated within the cradle 806 and above a fluid level F in the reservoir 908 and, optionally, such that the shaver 860 rests against the tower 912. To perform a cleaning operation, the user grasps the grip 946 of the plunger 936 and manually urges the plunger 936 downward within the passageway 934 of the cylinder 928 to compress against the bias of the biasing member 964 such that at least a portion of the displacement apparatus 948 is submerged in the fluid, thereby displacing fluid and raising the fluid level F within the reservoir 908. When the fluid level F is raised to a predetermined height within the reservoir 908, at least a portion of the cradle 806 and the shaver head 862 are submerged in the fluid, and the user locks the plunger 936 in its depressed position relative to the cylinder 928. The user leaves the plunger 936 locked (i.e., leaves the shaver head 862 of the shaver 860 at least partially submerged in fluid) for a desired period of time to suit a given level of cleanliness. After the desired period of time elapses, the user unlocks the plunger 936 from the fixed position and allows the plunger 936 to undepress due to the biasing force of the biasing member 964, thereby raising the displacement apparatus 948 at least in part from the fluid and lowering the fluid level F within the reservoir 908. When the shaver head 862 is above the fluid level F, the biasing member 964 maintains the displacement apparatus 948 in the raised position (i.e., maintains the shaver head 862 above the fluid level F) to facilitate drying the shaver head 862. Alternatively, the user may repeat the cleaning operation to achieve any desired level of cleanliness.

Figure 22:
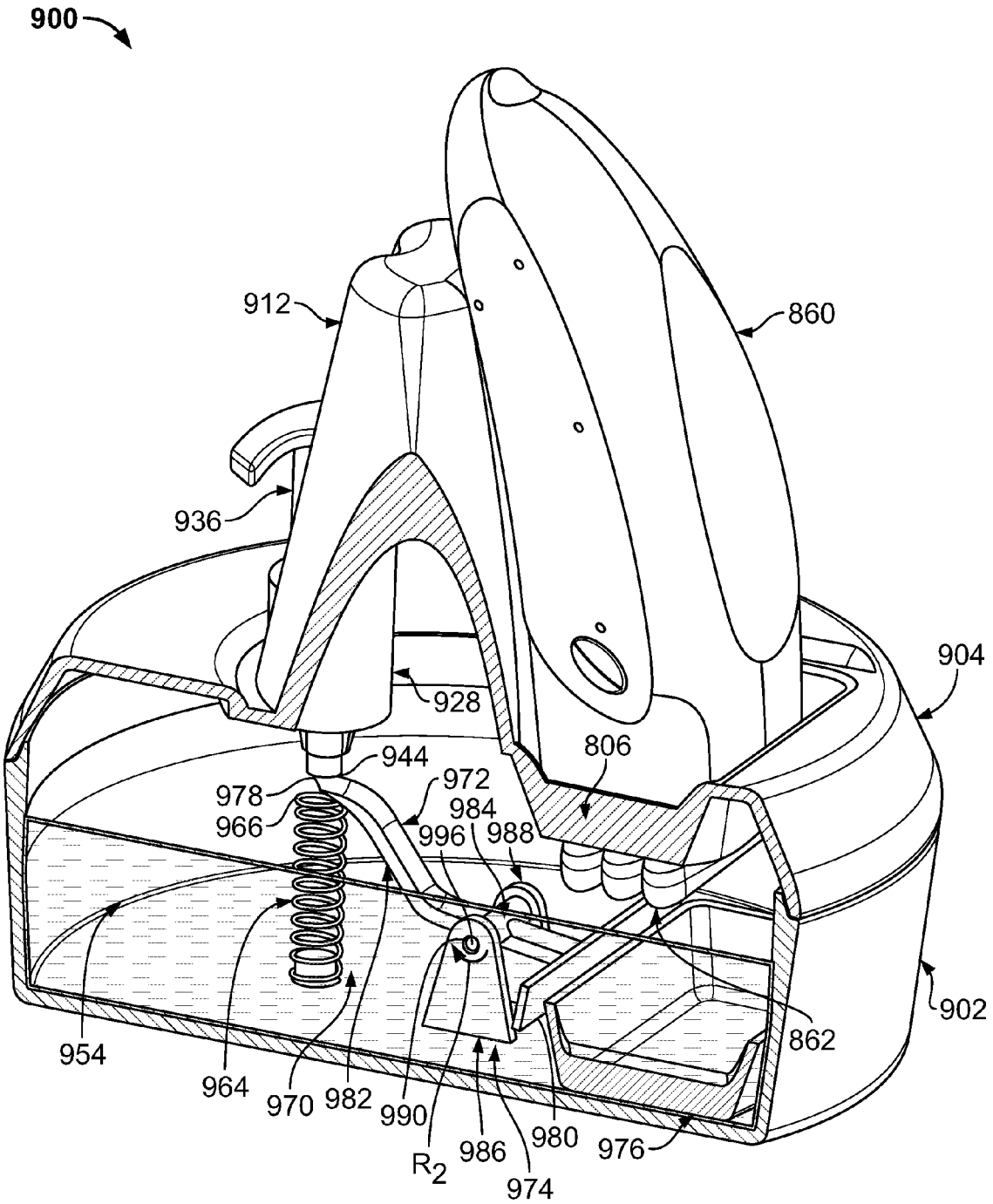
FIG. 22 is a section of a third embodiment of a cleaning system for an electric shaver with the cleaning fluid level lowered.
Figure 23:
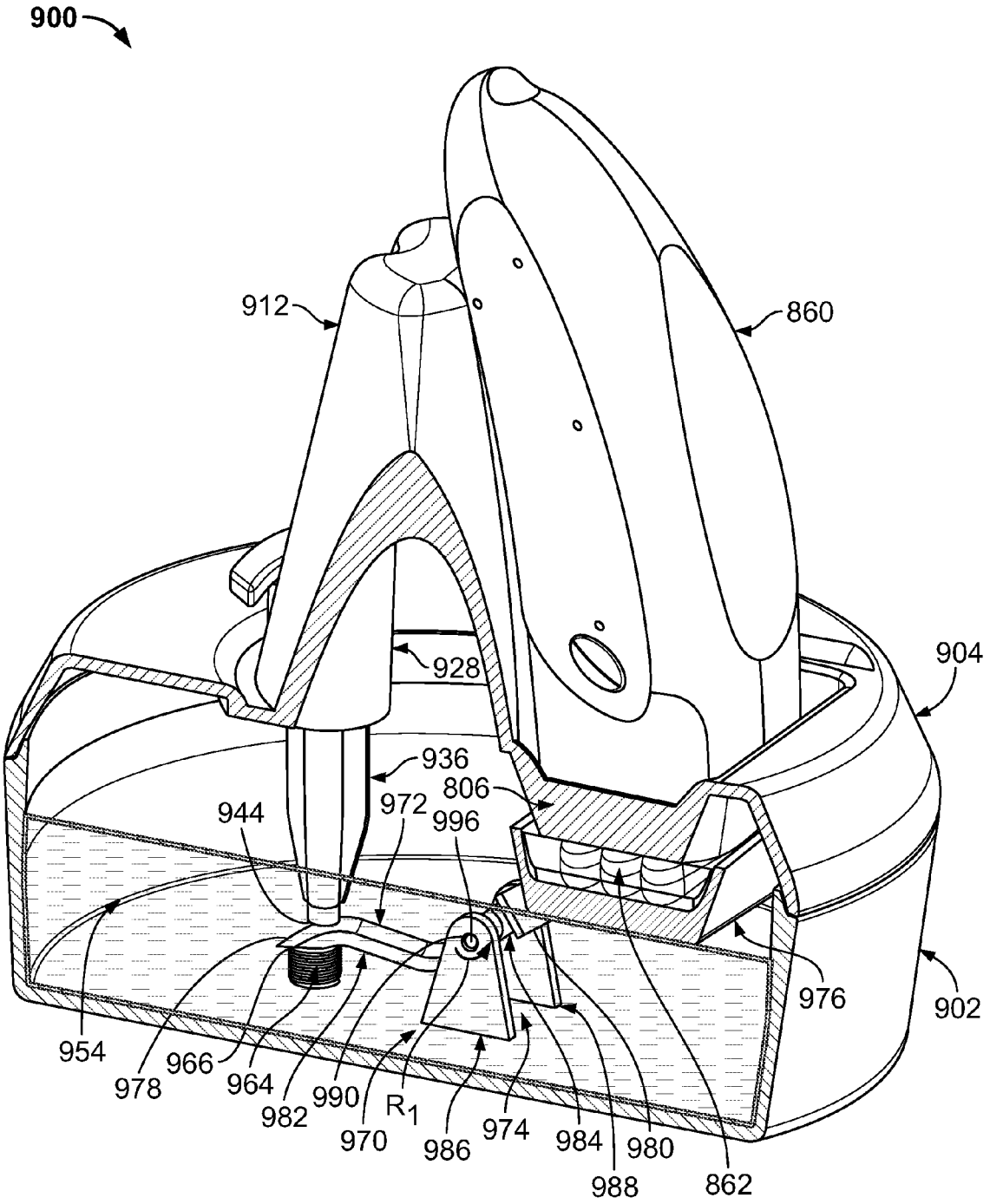
FIG. 23 is a section of the cleaning system of FIG. 22 with the cleaning fluid level raised.

FIGS. 22-23 illustrate a third embodiment of a cleaning system in which the system 900 comprises a lifting apparatus 970 for use in conjunction with, or in the illustrated embodiment in lieu of, the displacement apparatus 948. The lifting apparatus 970 comprises a lever 972, a fulcrum assembly 974, and a tray 976. The lever 972 comprises a first end 978, a second end 980, a middle portion 982 extending from the first end 978 to the second end 980, and a hollow crossbar 984 extending substantially perpendicular to the middle portion 982. The first end 978 of the lever 972 is connected to the second end 944 of the plunger 936 and/or the first end 966 of the biasing member 964 via a suitable fastener, and the second end 980 of the lever 972 is connected to the tray 976 via a suitable fastener. In the illustrated embodiment, the middle portion 982 and the crossbar 984 are integrally formed together. Alternatively, the middle portion 982 and the crossbar 984 may be formed separate and fastened together by a suitable fastener.

The fulcrum assembly 974 comprises a first support 986 and a second support 988 spaced apart from one another. The first support 986 comprises a first aperture 990, and the second support 988 comprises a second aperture (not shown). The first aperture 990 and the second aperture are substantially concentrically aligned, and the crossbar 984 is positioned between the first support 986 and the second support 988 such that an eyelet defined through the crossbar is substantially concentrically aligned with the first aperture 990 and the second aperture. Suitably, a pin 996 extends from the first aperture 990, through the eyelet, and into the second aperture such that the lever 972 is pivotable about the pin 996.

In operation, when the user manually urges the plunger 936 downward within the cylinder 928 (e.g., to a depressed position as described above), the lever 972 pivots about the pin 996 in a first rotational direction $R_1$ such that the tray 976 raises fluid toward the shaver head 862 to facilitate cleaning the shaver head 862. Where the user slides the plunger 936 upward within the cylinder 928 (as described above), the lever 972 pivots about the pin 996 in a second rotational direction $R_2$ that is opposite the first rotational direction $R_1$ such that the tray 976 lowers to facilitate drying the shaver head 862 (as described above).

When introducing elements of the present invention or the preferred embodiment(s) thereof, the articles "a", "an", "the", and "said" are intended to mean that there are one or more of the elements. The terms "comprising," "including", and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A cleaning system for an electric shaver having a shaving head, the cleaning system comprising:

a housing comprising a shaver support retained in a stationary position relative thereto, said housing having a reservoir disposed therein and configured to contain cleaning fluid within the housing, the shaver support being configured relative to the housing to support the shaver such that the shaving head of the shaver is disposed at least in part within the housing during operation of the cleaning system; and a displacement apparatus disposed within the housing and being selectively positionable within the housing relative to the shaver support between a first position in which the cleaning fluid within the reservoir defines a lower fluid level relative to the shaver support, and a second position in which the cleaning fluid defines a higher fluid level relative to the shaver support such that at the higher fluid level at least a portion of the shaving head of the shaver is submerged in the cleaning fluid within the reservoir, wherein the shaver support being stationary relative to the housing maintains the shaver stationary during the selective positioning of the displacement apparatus from the first position to the second position.

2. The cleaning system set forth in claim 1 wherein in the second position of the displacement apparatus said displacement apparatus is submerged in the cleaning fluid an amount greater than in the first position of the displacement apparatus.

3. The cleaning system set forth in claim 1 further comprising a plunger operatively connected to the displacement apparatus for selectively adjusting the position of the displacement apparatus within the housing from said first position to said second position.

4. The cleaning system set forth in claim 1 further comprising a biasing element acting on the displacement apparatus to bias the displacement apparatus toward its first position.

5. The cleaning system set forth in claim 1 wherein the shaver support comprises a cradle configured to receive the shaving head of the shaver.

6. The cleaning system set forth in claim 5 wherein the cradle is configured to receive a shaver having a shaving head that is either generally rectangular or generally triangular in cross-section.

7. The cleaning system set forth in claim 5 wherein the cradle comprises a shoulder oriented to seat the shaving head in the cradle at an angle relative to the lower fluid level of cleaning fluid in the reservoir.

8. The cleaning system set forth in claim 5 wherein the housing comprises a lower housing and an upper housing, the cradle being held in assembly with the upper housing for conjoint placement on and removal from the lower housing.

9. The cleaning system set forth in claim 3 further comprising a float operatively connected to the plunger, said float being disposed within the housing and being at least partly submersible in the cleaning fluid for raising the level of cleaning fluid.

10. The cleaning system set forth in claim 1 wherein the housing is further configured to keep the reservoir of cleaning fluid uncovered when said displacement apparatus is in the first position.

11. A cleaning system for an electric shaver, the shaver having a body and a shaving head, the cleaning system comprising:

a housing configured for disposing a reservoir of cleaning fluid therein, said housing being further configured for supporting the shaver such that the shaving head of the shaver is disposed at least in part within the housing;

a plunger accessible exterior of the housing and extending into the housing, the plunger being selectively positionable relative to the housing and the shaver such that a manual force imparted to the plunger causes the level of cleaning fluid within the housing to be raised for submerging at least a portion of the shaving head in the cleaning fluid; and a float operatively connected to the plunger, said float being disposed within the housing and being at least partly submersible in the cleaning fluid for raising the level of cleaning fluid.

12. The cleaning system set forth in claim 11 wherein the float is selectively positionable within the housing between a first position in which the cleaning fluid within the housing defines a lower fluid level relative to the shaving head to be cleaned, and a second position in which the cleaning fluid defines a higher fluid level relative to the shaving head such that at the higher fluid level at least a portion of the shaving head of the shaver is submerged in the cleaning fluid within the housing.

13. The cleaning system set forth in claim 12 wherein in the second position of the float said float is submerged in the cleaning an amount greater than in the first position of the float.

14. The cleaning system set forth in claim 12 further comprising a biasing element acting on the float to bias the float toward its first position.

15. The cleaning system set forth in claim 12 wherein the housing comprises a cradle configured to receive the shaving head of the shaver.

16. The cleaning system set forth in claim 15 wherein the cradle is configured to receive a shaver having a shaving head that is either generally rectangular or generally triangular in cross-section.

17. The cleaning system set forth in claim 15 wherein the cradle comprises a shoulder oriented to seat the shaving head in the cradle at an angle relative to the lower fluid level of cleaning fluid in the housing.

18. The cleaning system set forth in claim 15 wherein the housing comprises a lower housing and an upper housing, the cradle being held in assembly with the upper housing for conjoint placement on and removal from the lower housing.

* * * * *